United States Patent [19]

Gulliksen

[11] 4,164,012

[45] Aug. 7, 1979

[54] LUMINAIRE APPARATUS FOR REFLECTING RADIANT ENERGY AND METHODS OF CONTROLLING CHARACTERISTICS OF REFLECTED RADIANT ENERGY

[75] Inventor: John E. Gulliksen, Shrewsbury, Mass.

[73] Assignee: Koehler Manufacturing Company, Marlborough, Mass.

[21] Appl. No.: 807,372

[22] Filed: Jun. 17, 1977

[51] Int. Cl.[2] ..... F21V 21/28

[52] U.S. Cl. ..... 362/282; 362/292; 362/309

[58] Field of Search ..... 362/282, 287, 299, 292, 362/336, 309

[56] References Cited

U.S. PATENT DOCUMENTS

| | | | |
|---|---|---|---|
| 3,635,037 | 1/1972 | Hubert | 62/3 |
| 3,719,052 | 3/1973 | White | 62/3 |
| 3,725,697 | 4/1973 | Wince | 362/294 |
| 4,021,659 | 5/1977 | Wiley | 362/297 |
| 4,028,542 | 6/1977 | McReynolds, Jr. | 362/297 |
| 4,041,306 | 8/1977 | Compton et al. | 362/297 |

*Primary Examiner*—Peter A. Nelson
*Attorney, Agent, or Firm*—Munroe H. Hamilton

[57] ABSTRACT

A source of radiant energy is combined with spaced apart reflecting surfaces which are sections of paraboloids of revolution and which have a common focal point but differing focal lengths. Radiant energy is reflected in substantially parallel rays and passed through radiation transmitting means which include radiation controls zones. The reflecting surfaces and the radiation transmitting means are mounted for rotary displacement of one relative to the other to vary the distribution pattern, intensity, color, and other characteristics of the reflected radiant energy in a unique manner. Radiation output from the source of radiant energy may be instantly tailored to a task at hand such as may arise, for example in theatrical lighting, mine lighting, police and surveillance work, military operations, fire fighting, sports activity, illumination of recreational areas and the like. By means of the unique construction and arrangement of the reflecting and transmitting components, it becomes possible to achieve a relatively high degree of efficiency and operating life in a range of luminaire sizes which can be manufactured on a commercially feasible basis.

44 Claims, 60 Drawing Figures

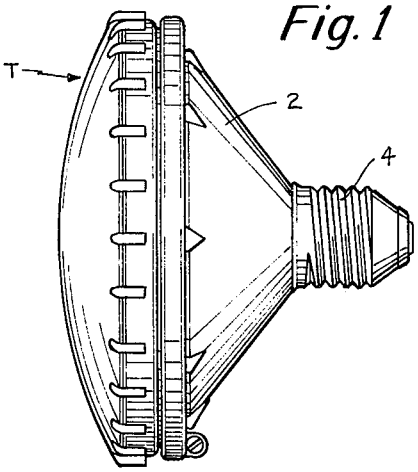
Fig. 1
T
2
4
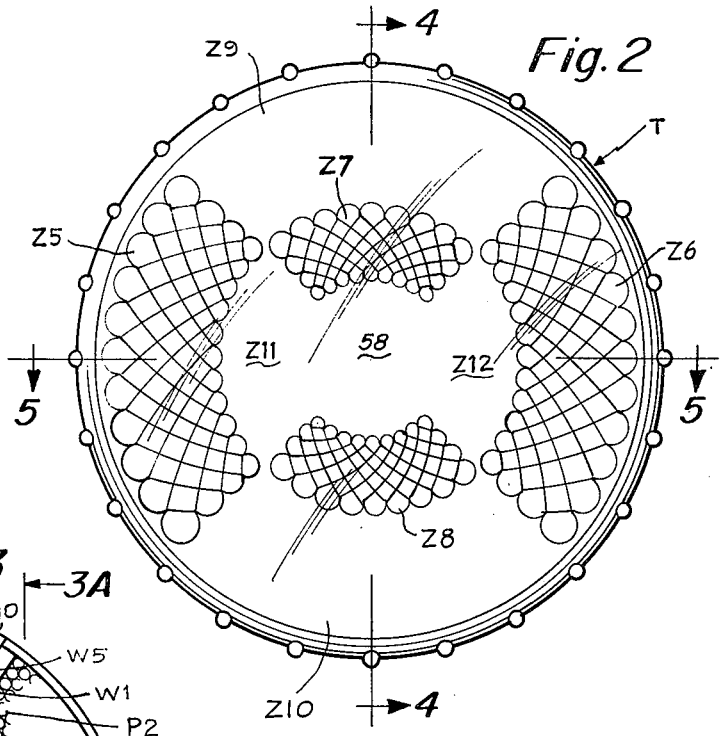
Fig. 2
4
Z9
T
Z7
Z5
Z6
Z11
58
Z12
5
5
Z8
Z10
4
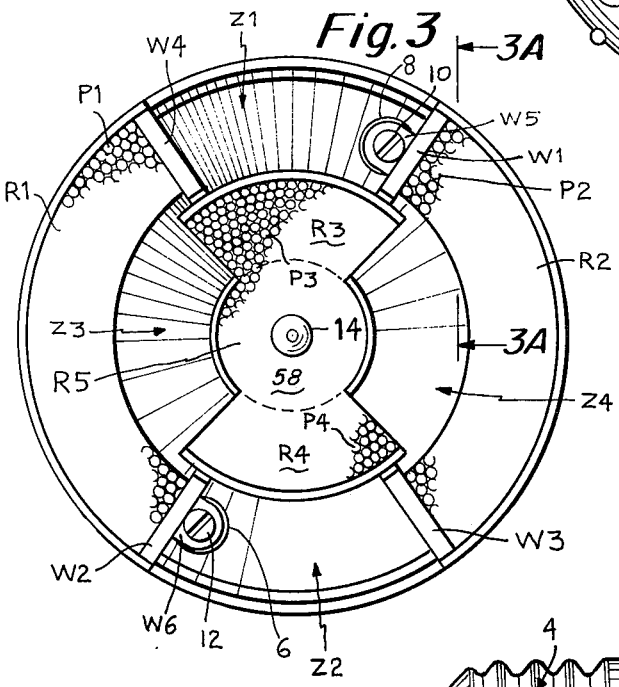
Fig. 3
Z1
W4
8
10
3A
P1
W5
W1
P2
R1
R3
R2
P3
Z3
14
3A
R5
58
Z4
P4
R4
W3
W2
W6
12
6
Z2
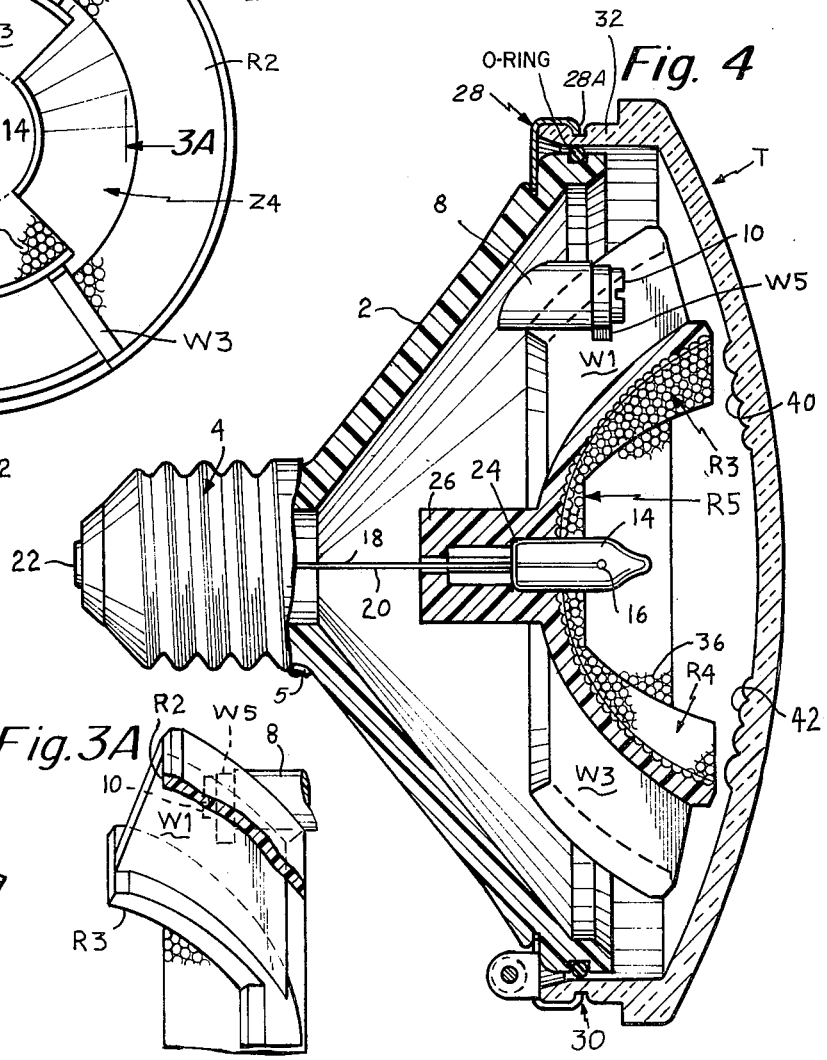
Fig. 4
32
O-RING
28A
28
T
8
10
W5
2
W1
40
R3
4
26
24
R5
14
22
18
20
16
36
R4
5
42
W3
30
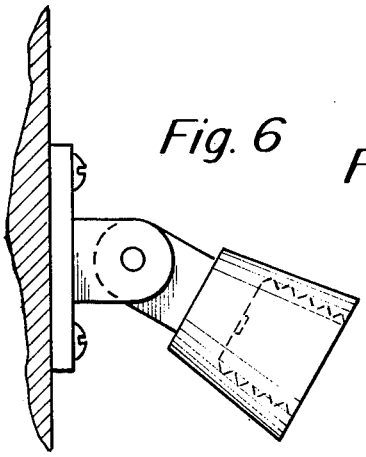
Fig. 6
Fig. 3A
R2
W5
8
10
W1
R3

Fig. 5
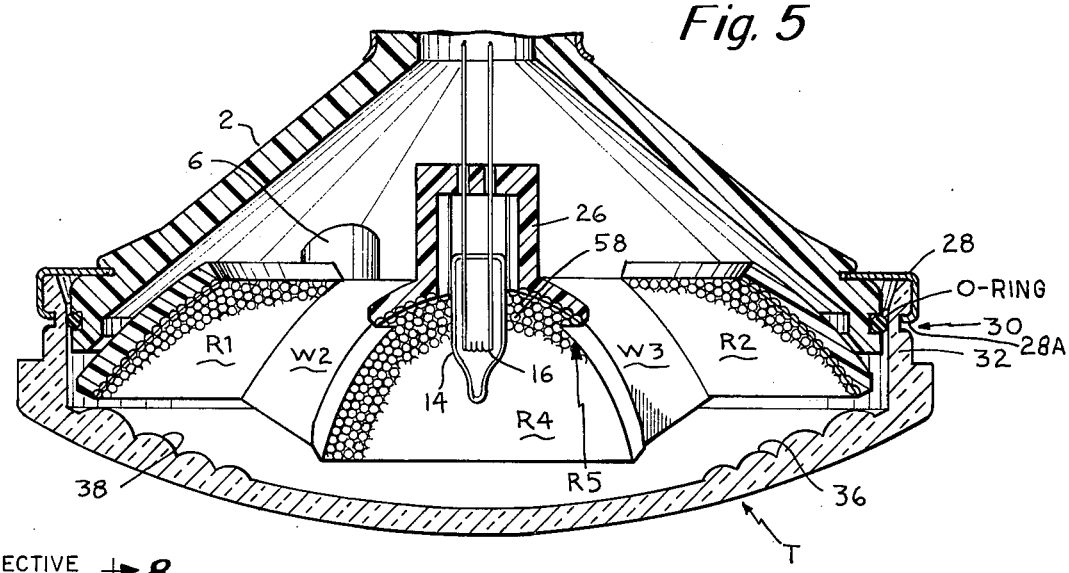
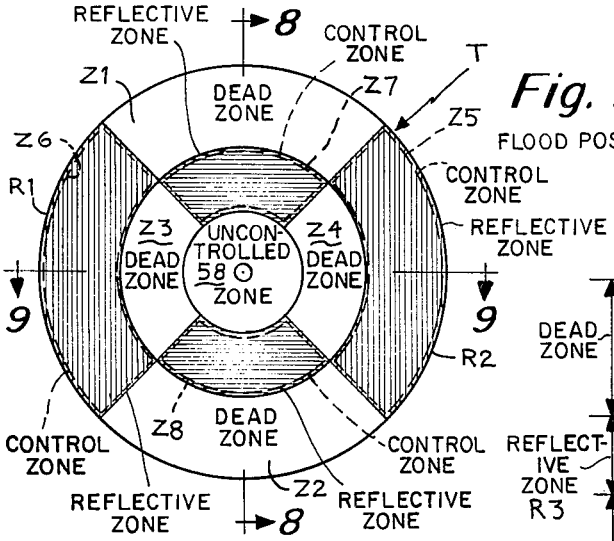
Fig. 7
FLOOD POSITION
Fig. 8
FLOOD POSITION
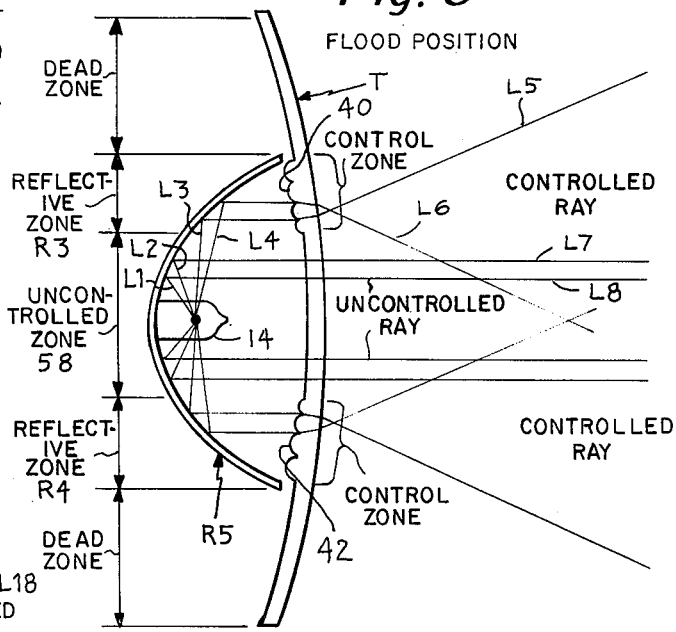
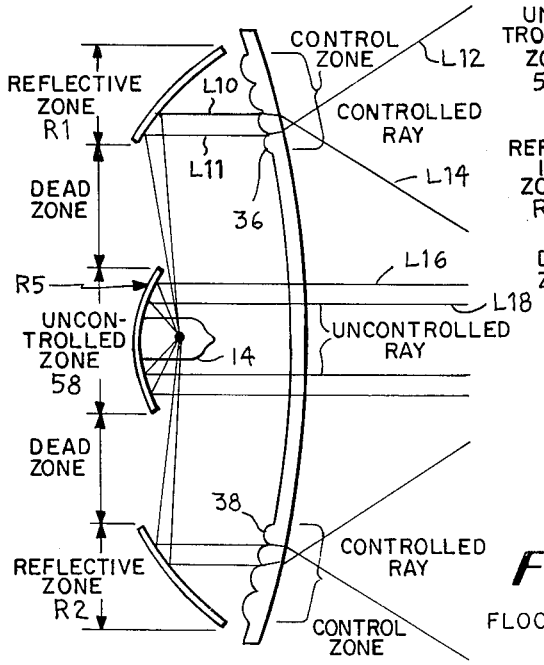
Fig. 9
FLOOD POSITION

SPOT POSITION

SPOT POSITION

SPOT POSITION

SPOT RAY PATTERN

FLOOD RAY PATTERN

Fig. 36
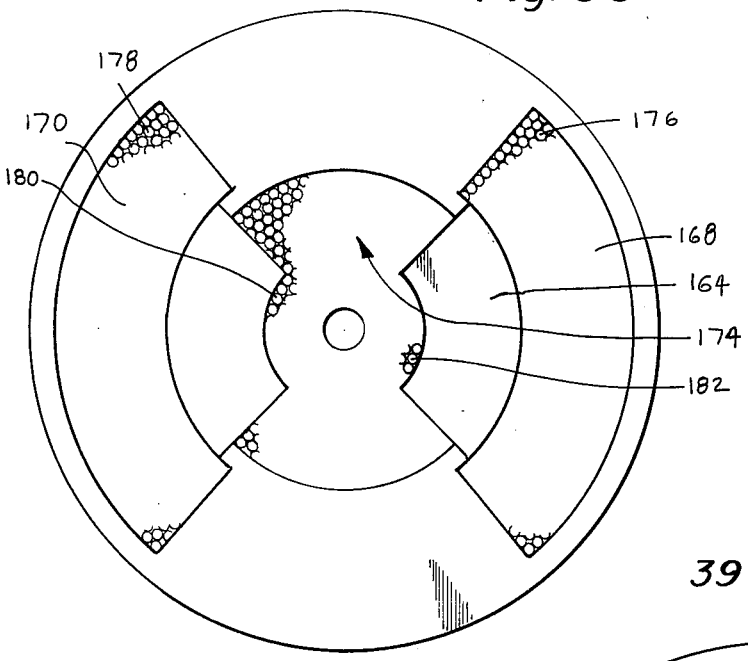
Fig. 37
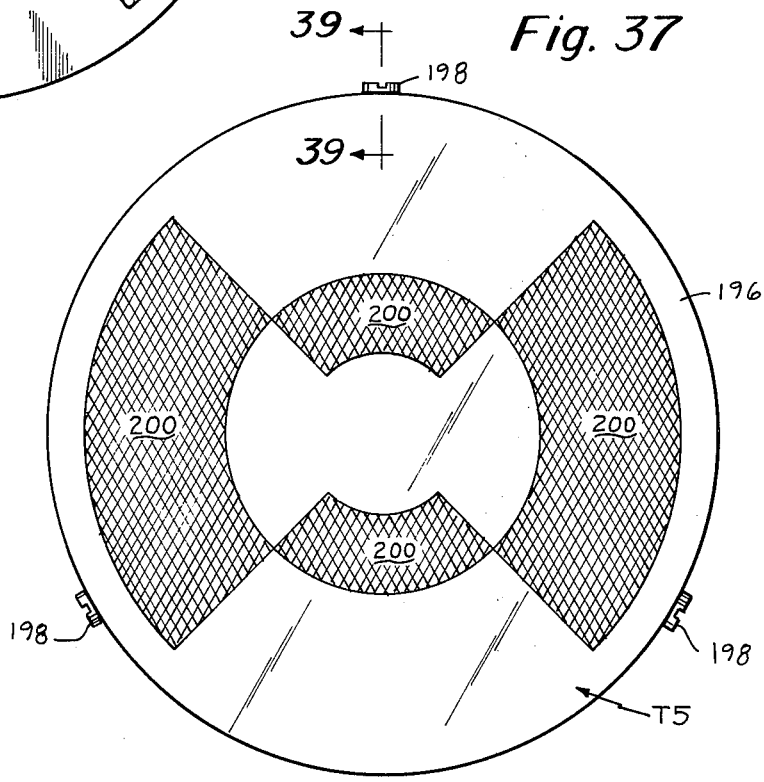
Fig. 38
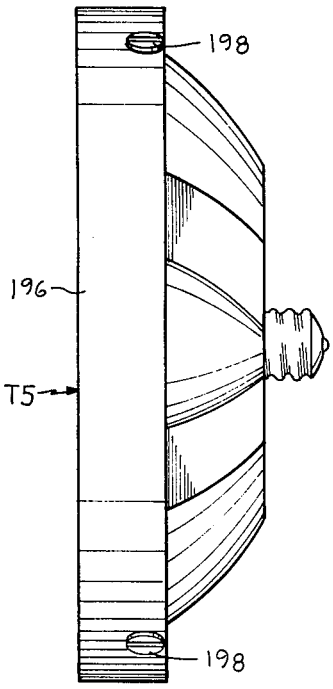
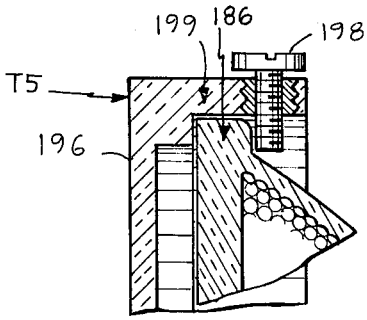
Fig. 39

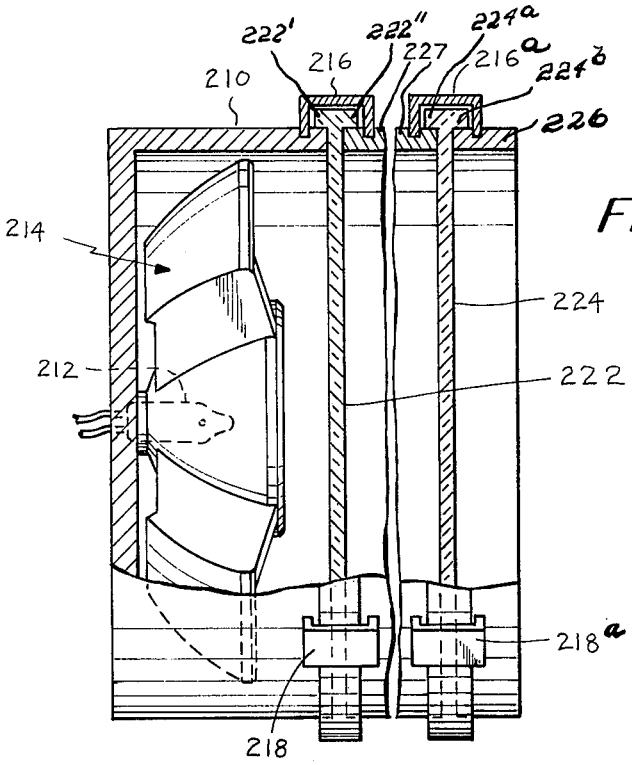
Fig. 40
Fig. 41
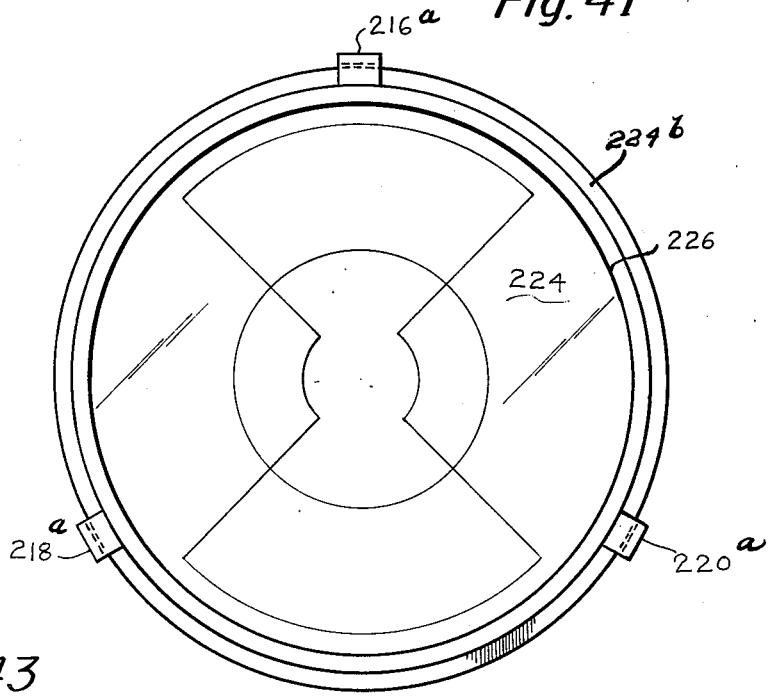
Fig. 42
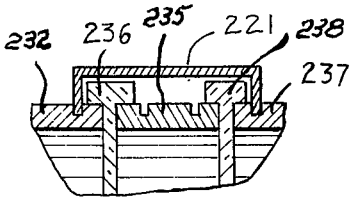
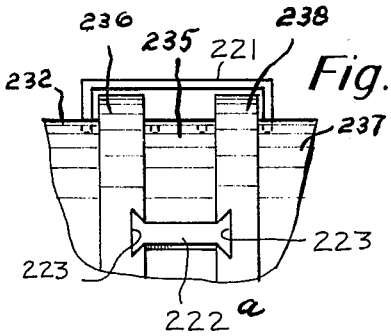
Fig. 43

LUMINAIRE APPARATUS FOR REFLECTING RADIANT ENERGY AND METHODS OF CONTROLLING CHARACTERISTICS OF REFLECTED RADIANT ENERGY

BACKGROUND OF THE INVENTION

In the luminaire art, control of reflected energy has been carried out in various ways utilizing several forms of reflecting apparatus and radiation transmitting devices. For example, it is customary to utilize for some purposes an iris type device with a source of reflected light. Other arrangements may include such devices as a hemispherical reflector, a radiant energy source movable with respect to a reflector body, a collimating lens, a light source combined with a movable sleeve, or as a radiant source combined with divided reflector sections, some or all of which are movable relative to one another. There has also been proposed use of dual lens elements supported in the path of travel of reflected radiant energy and being movable into and out of contact with one another. A further well-known device is a rotatable filter structure having differing sectors for producing changes in color, commonly referred to in the art as a "color wheel. " All of these systems are subject to disadvantages of one sort or another which limit their usefulness, efficiency and range of performance. Thus with an iris type aperture there is extreme inefficiency since, in going from a flood distribution to a spot distribution, a large percentage of available radiation is masked. A movable source of radiant energy is limited in use to producing either a spot distribution or a defocussed annular configuration. A similar limitation is present with a collimating lens and even less efficiency is obtainable. The use of a movable sleeve with a radiant source is quite inefficient, and the use of divided reflector sections or dual lens means are, for many luminaire users, impractical to construct and operate.

SUMMARY OF THE INVENTION

The present invention relates to the luminaire art and is particularly concerned with improved methods and apparatus for controlling and modifying reflected radiant energy. A chief object of the invention is to provide a luminaire apparatus whose radiant energy output can be adjusted with minimal loss of efficiency. Another object is to devise an arrangement of luminaire components by means of which reflected radiant energy may be rapidly and conveniently adjusted or altered to meet with varying requirements such as changes in radiation distribution, intensity, color, polarization and other characteristics.

It is a further object of the invention to provide an adjustable luminaire apparatus which can be formed with a standard screw or other type of base so that it may be used to replace standard sealed beams or PAR-type bulbs which are lacking in versatility.

Still another object is to combine a luminaire apparatus for controlling radiation from a source of radiant energy with means for energizing the light source by means of a battery located either externally or internally of the apparatus or by means of an A.C. power source.

It has been determined that these objectives may be realized by means of a newly devised reflector system in combination with one or more radiation transmitting members and an electrical power supply. A source of of radiant energy energized by the power supply is combined with spaced apart reflector surfaces which are sections of paraboloids of revolutions and which have a common focal point but differing focal lengths. Radiant energy is reflected in substantially parallel rays and passed through one or more radiation transmitting members which include radiation control zones, the planar projections of which are related in size and shape to the planar projections of some of the paraboloidal reflecting surfaces. The reflecting surfaces and the radiation transmitting members are mounted for rotary displacement of one relative to the other thereby to selectively control characteristics of radiant energy transmitted through control zones of the radiation transmitting members.

BRIEF DESCRIPTION OF THE DRAWINGS

FIG. 1 is a side elevational view of one desirable form of luminaire apparatus of the invention.

FIG. 2 is a front elevational view of the apparatus of FIG. 1.

FIG. 3 is another front elevational view of the apparatus of FIGS. 1 and 2 with a lens member having been removed to indicate more clearly reflecting surfaces employed.

FIG. 3*a* is a detailed perspective view of the supporting walls between reflector segments.

FIG. 4 is a cross section taken on the line of 4—4 of FIG. 2.

FIG. 5 is a cross section taken on the line of 5—5 of FIG. 2.

FIG. 6 is a fragmentary detail view illustrating one form of mounting the luminaire apparatus on a supporting structure.

FIG. 7 is a diagrammatic view illustrating a radiation transmitting member superimposed over a reflector body, with control zones in one desired position of adjustment and indicating schematically reflecting zones and nonreflecting zones.

FIG. 8 is a cross sectional view taken on the line 8—8 of FIG. 7.

FIG. 9 is a cross sectional view taken on the line 9—9 of FIG. 7.

FIGS. 36–39 inc. are views illustrating the adjustable radiation control system produced by the method of FIGS. 33–35, inc. in combination with the addition of a radiation control member.

FIG. 40 is a cross sectional view of a luminaire in which a plurality of radiation control members are combined one beside another.

FIG. 41 is a front elevational view of the luminaire shown in FIG. 40.

FIG. 42 is a view showing a radiation transmitting assembly which can be secured in interlocking relationship.

FIG. 43 is a detail view showing keying means for holding adjacent radiation transmitting elements together.

DETAILED DESCRIPTION OF THE INVENTION

Figure 10:
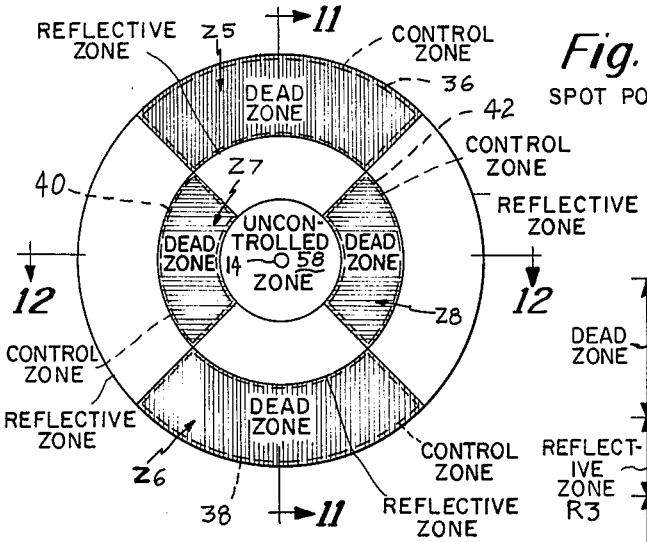
FIG. 10 is a view similar to FIG. 7 further illustrating radiation control means with control zones in a second desired position of adjustment.

In FIGS. 1–15 inclusive there is illustrated one desirable form of luminaire apparatus for carrying out the invention method and selectively controlling and varying the distribution pattern, intensity, color, polarization and/or other characteristics of reflected radiant energy. In this embodiment of luminaire apparatus there is provided an arrangement of parts which includes a standard screw base so that the luminaire may be used to replace standard PAR-type bulbs.

It is intended that this arrangement of parts be illustrative of other arrangements for carrying out the invention method as hereinafter disclosed and it should be understood that the invention is not limited in its application to the embodiment of FIGS. 1–15 or those shown in the remaining Figures.

Principal parts of the luminaire shown in FIGS. 1–12 include a source of radiant energy, a supporting body or housing in which the source of radiant energy is received, paraboloidal reflector members mounted within the housing and radiation transmitting means arranged to lie in the path of travel of rays of reflected radiant energy from the reflector members.

Essential features of this luminaire assembly include (1) provision of a plurality of reflector surfaces which are sections of paraboloids of revolution and having a common focal point but differing focal lengths; (2) the combination with the reflector surfaces of radiation transmitting means characterized by zones of radiation control related to the surfaces.

The expressions "paraboloidal" and "sections of paraboloids of revolution" as employed in the specification and claims of this application is intended to refer to a surface or surfaces of revolution whose basic mathematical root is a standard parabolic curve expressed by the equation $$(Y-Yo)^2=4a(X-Xo)$$

where:

a is focal length

Xo and Yo are the coordinates of the origin and

X and Y are the coordinates of any point on the parabolic cross section of the surface.

Addition or subtraction of a constant term from either X or Y coordinates or from both may be desirable.

Referring in more detail to FIGS. 1–12 numeral 2 denotes a luminaire housing which is of conical shape and formed with a threaded base 4 of a conventional construction suitable for engaging in a socket of the class used to receive a PAR-type bulb. At the inner surface of the housing 2 are provided a pair of oppositely located mounting posts 6 and 8. Preferably the posts 6 and 8 may be formed as an integral part of the housing by moulding or other desirable means and are further formed with internally threaded openings.

Mounted on the posts 6 and 8 is a unitary moulded reflector body which is more clearly illustrated in FIGS. 3, 4, and 5 and which is formed with a pair of reflector segments R1 and R2 derived from the parabolic and being of a common, relatively long focal length and another reflector segment denoted by arrow R5 derived from the parabolic and of relatively short focal length. The segment generally denoted by the arrow R5 is divided for purposes of illustration into component reflector segments R3, R4, and 58, the latter being partially defined by arcuate dashed lines as indicated in FIG. 3. The two pairs of paraboloidal reflector segments are connected to one another by joining walls W1, W2, W3 and W4 most clearly shown in FIG. 3 and also indicated in FIGS. 4 and 5 and the walls W1 and W2 are further formed with lug portions W5 and W6 for receiving mounting screws 10 and 12 to solidly secure the unitary reflector body against the housing 2. Centrally disposed in the paraboloidal reflector segment R5 is a source of radiant energy which may, for example, consist of a bulb member 14 having a filament 16 which is electrically connected by conductor wires 18 and 20 to the terminal end 22 and the base 5 of the member indicated by arrow 4. The bulb base is contained in a recess 24 in a bulb receptacle portion 26 formed as an integral part of the moulded reflector segment R5 as is more clearly indicated in FIGS. 4 and 5.

The location of filament 16 is chosen to be at a common focal point for both the pair of reflector segments R1 and R2 and the reflector segment R5.

Rotatably secured around an outer edge of the conical housing 2 is a radiation transmitting member generally denoted by the arrow T. An O ring provides for sealing engagement and a retaining clip element 28 fastened to the housing is formed with a hooked end 28A slidably engaged in a groove 30 formed in an annular flange portion 32 of the member T. By means of this arrangement the member T may be rotated into any desired position as hereinafter described in more detail.

It will be observed that the paraboloidal reflector segments R1, R2, and R5 occur in spaced apart relation to define reflecting zones and non-reflecting or dead zones Z1, Z2, Z3, Z4 as indicated diagrammatically in FIG. 7 and the reflecting surfaces of the members may in a preferred form be textured as suggested diagrammatically at P1, P2, P3, and P4. This prevents projection of the reflected radiation appearing as a configuration of the reflector surfaces where a plurality of reflector surfaces are employed in accordance with the invention.

In accordance with the invention these reflecting zones and dead zones are utilized as reference areas for determining the formation of radiation control zones in the radiation transmitting means T.

Thus the radiation transmitting means T may be constructed with a plurality of radiation control zones, the planar projections of which are related in size and shape to the planar projections of some of the paraboloidal reflecting surfaces which makes possible a selective control of characteristics of radiant energy transmitted therethrough when the member T is rotated through varying positions of adjustment on the luminaire housing.

As one example of controlling transmitted characteristics of radiant energy there has been illustrated in transmitting means T radiation control zones for providing a radiation output which may have a spot configuration or a flood configuration. These control zones referred to are related in size and shape to the reflector segments R1, R2, R3 and R4 as well as the reflector dead zones Z1, Z2, Z3, Z4 and are illustrated in FIG. 2 in one position of rotation of the member T. As shown therein control zones Z5 and Z6 correspond in dimension and location to the reflector surfaces R1 and R2. Similarly control zones Z7 and Z8 correspond in dimension and location to the reflector segments R3 and R4. All four of these control zones may be referred to as diffuser zones and are formed at inner surface portions thereof with multiple convex lens elements having very short focal lengths as indicated in FIG. 4 at 40 and 42 and in FIG. 5 at 36 and 38. With the arrangement of control zones illustrated in FIG. 2, parallel reflected rays from the reflector surfaces entering these convex lens elements at 36, 38, 40 and 42 cross at the focal points upon leaving the lens element and diverge from these points producing a "flood" configuration with minimal loss of energy.

It will be observed that the transmitting member T as shown in FIG. 2 is also formed with additional control zones Z9, Z10, Z11, Z12 which are made without convex lens elements to receive and transmit parallel rays of radiation without diffusion or other change.

It should also be noted that in FIG. 2 these control zones Z9, Z10, Z11, Z12 correspond in shape to and are located in front of the dead zones Z1, Z2, Z3, Z4 of the reflector body 2 and in such a position do not perform any useful function. However, these control zones Z9, Z10, Z11 and Z12, if moved into a position in which radiation is transmitted therethrough, provide for parallel rays moving along parallel paths of travel without any change taking place in which case a "spot" configuration may be produced.

Figure 11:
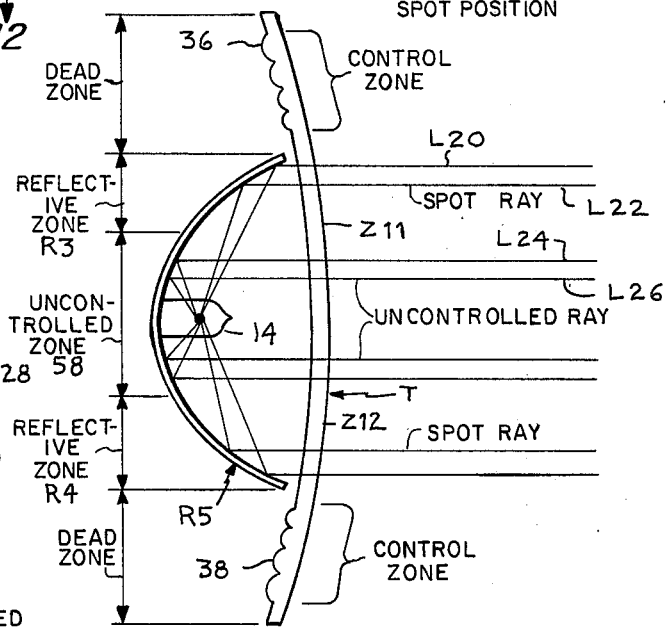
FIG. 11 is a cross section taken on the line 11—11 of FIG. 10.
Figure 12:
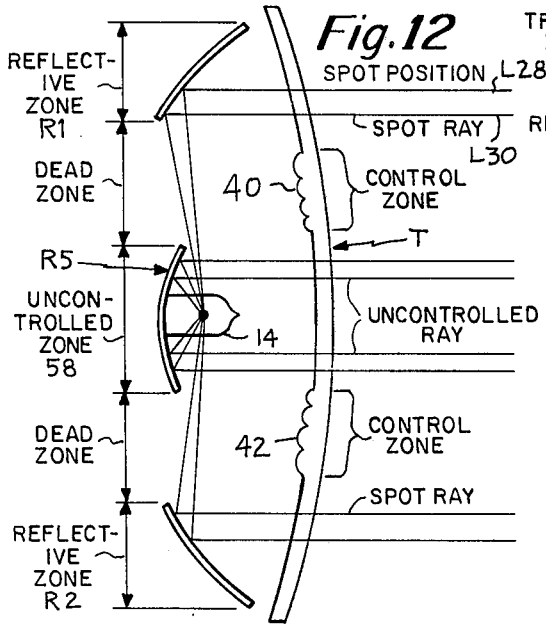
FIG. 12 is a cross section taken on the line 12—12 of FIG. 10.

Controlling characteristics of reflected radiation to provide for producing a flood configuration and then changing to a spot configuration is illustrated in FIGS. 7–9 inc. and in FIG. 10–12 inc. in which simplified ray diagrams are employed to indicate schematically varying paths of travel of rays.

In FIG. 7 the radiation transmitting means T is again shown in a flood position with its control zones Z5, Z6, Z7 and Z8 located in front of respective reflector surfaces R1, R2, R3, and R4. Radiant energy from the source 14 moves into contact with the reflector surfaces R1, R2, R3 and R4.

In FIG. 8 reflector surface R5 is shown with rays L1, L2, L3 and L4 being reflected outwardly along parallel paths of travel. However, the rays L3 and L4 enter the convex lens elements 40 of T and cross at the focal points upon leaving the lens elements and diverge as suggested by the rays thus producing a flood configuration. At the same time reflector rays as L1 and L2 moving in parallel paths are not changed and continue outwardly along their parallel paths of travel to merge with diffused rays. It will be understood that similarly rays reflected by surface R4 will be controlled by the convex element 42.

In FIG. 9 reflectors R1 and R2 are indicated diagrammatically with rays L10 and L11 being reflected outwardly from reflector surface R1 and entering the convex elements 36 to again produce diffusing rays L12 and L14 and a similar diffusion of rays from reflector surface R2 will take place at 38 while rays L16 and L18 are unchanged.

Assuming that the flood configuration is in effect and it is desired to vary the flood configuration and produce a spot configuration the radiation transmitting means T is rotated on the housing 2 for example through an arc of 90 degrees with a position such as that shown in FIG. 10. In this position of adjustment the control zones Z5, Z6, Z7 and Z8 are located in front of the dead zones Z1, Z2, Z3, and Z4 of the reflector body and control zones Z9, Z10, Z11 and Z12 are located in front of the reflector surfaces R1, R2, R3 and R4. As shown in the ray diagram of FIG. 11 rays L20, L22, L24 and L26 are reflected from the reflector surface R3, pass through the control zone Z11, and no longer undergo diffusion but continue outwardly in parallel relation to thus produce a spot configuration. Similarly, rays reflected from surface R4 pass through Z12 without change.

Figure 13:
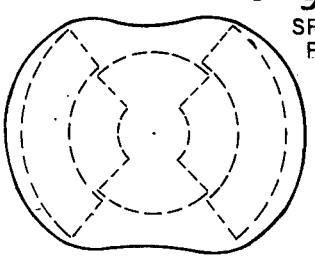
FIGS. 13–15 inc. are diagrammatic views illustrating stages of modifying transmitted rays of radiant energy being changed from a spot configuration to a flood configuration.

In FIG. 12 reflected rays L28, L30 from reflector surface R1 are transmitted without change which produce a spot configuration. Also reflected rays from reflector surface R2 remain parallel to produce a spot configuration. It will be appreciated that the transition from spot to flood or vice versa may be carried out rapidly or in a gradually changed manner. FIG. 13 illustrates diagrammatically a spot configuration obtained with four control zones which allow rays to remain parallel and provide an oval shaped spot configuration.

Figure 14:
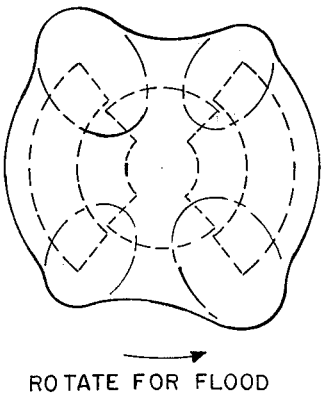
Figure 15:
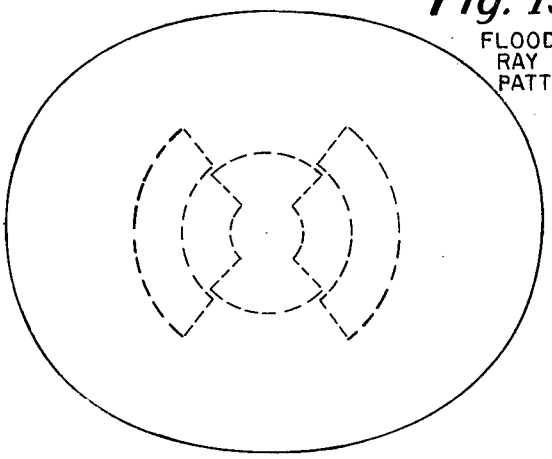
Figure 16:
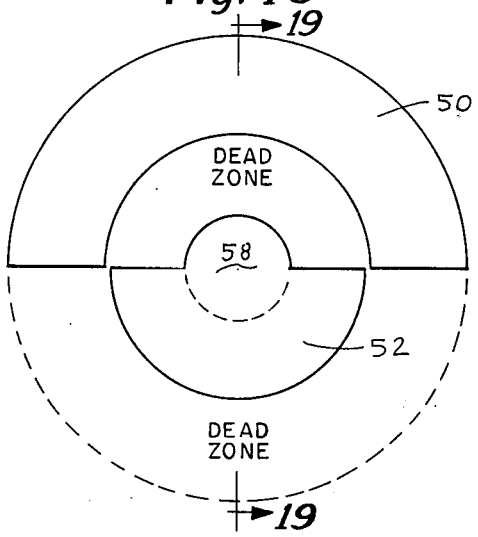
FIG. 16 is a diagrammatic view illustrating schematically a modified form of luminaire reflector in which two reflector segments are provided.

FIG. 14 illustrates an intermediate position of the radiation transmitting element T in which some diffusion is taking place and FIG. 15 illustrates a fully flooded configuration.

In general, degree of radiation control can be maximized by utilizing the focal length of one set of parabolic surfaces as short as possible and the focal length of another set of paraboloidal surfaces as long as possible with both sets of reflectors being as deep as possible consistent with the volume available for the reflector system.

The method and means for producing either a flood configuration or a spot configuration of reflected radiant energy as described above and shown in FIGS. 1–15 inclusive is capable of being modified in various ways to provide for controlling reflected radiation in other important respects. For example a radiation transmitting member having one or more sections of color filters may be employed to provide a range of coloring shades and patterns. Similarly, the nature of the reflected radiation may be modified as by the use of polarizing filter sections in the control zones of the radiation transmitting member. Still further such changes as intensity control, signalling and the like are readily achieved.

In carrying out control of radiation in any one of the various ways suggested utilizing the control zone technique of the invention, it should also be understood that other important modifications may be resorted to in designing systems employing the foregoing method and as examples of such modifications attention is directed to FIGS. 16–40 and FIGS. 44–47 inclusive.

One such modification may consist of utilizing a lesser number of reflector surfaces than the three surfaces R1, R2, and R5 described above. As shown in FIGS. 16–19 inc. only two reflector segments are combined with a radiation transmitting member T1. The two include a paraboloidal segment 50 of relatively long focal length and a segment 52 of relatively short focal length and both segments have a common focal point at 54 at which a source of radiation may be placed.

The use of two segments in place of three may be determined by the requirements for any given instance of use. The paraboloidal curves for the two surfaces of revolution are sections of paraboloids of revolution employing the standard parabolic equations noted above and being dependent on the degree of light control desired and the amount of losses due to the base of the light source that can be tolerated. Dimensional characteristics of the segments will be determined by the allowable depth of the luminaire systems as well as its allowable overall diameter, and edges of the segments may be allowed to overlap one another in some cases. Care must be taken to insure that the focal points of both curves are coincident which requires a solution of simultaneous equations.

Figure 17:
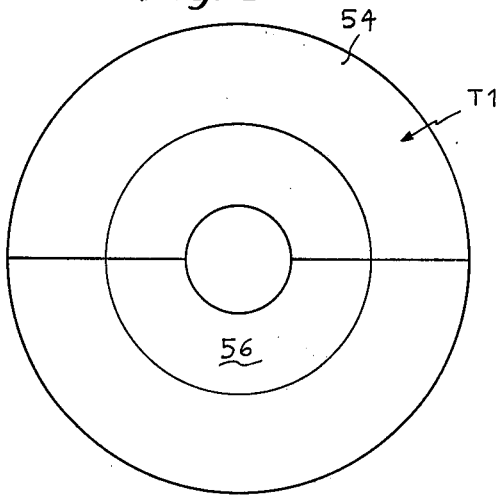
FIG. 17 is a diagrammatic view of a radiation transmitting member to be utilized with the luminaire apparatus of FIG. 16.
Figure 18:
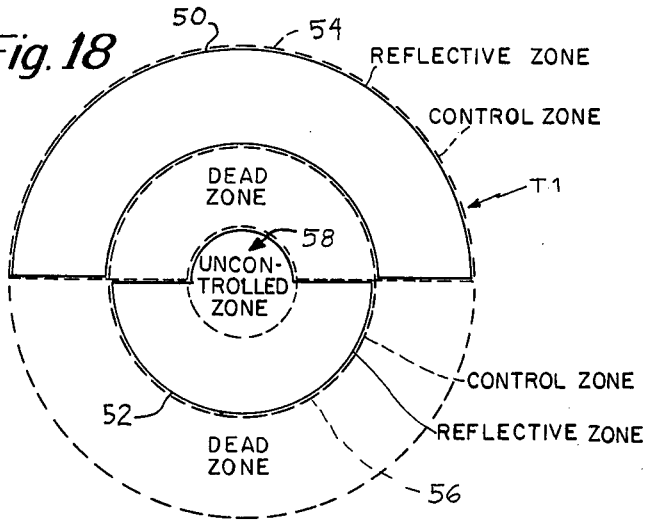
FIG. 18 is a view further illustrating the radiation transmitting member of FIG. 17 superimposed on the apparatus of FIG. 16.
Figure 19:
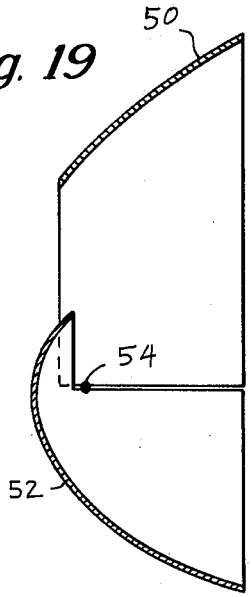
FIG. 19 is a cross section taken on the line 19—19 of FIG. 16.
Figure 20:
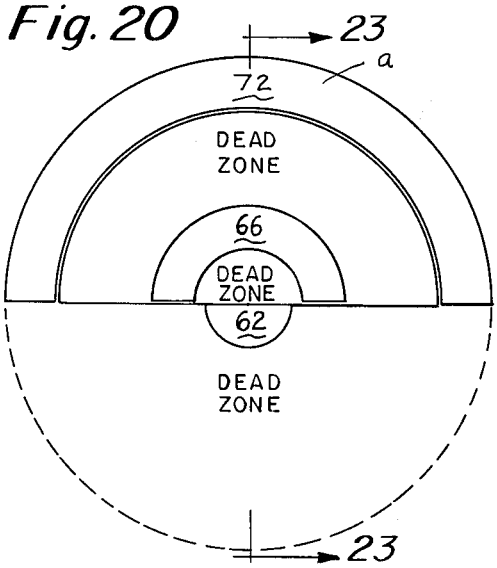
FIG. 20 is a diagrammatic view of another modification of luminaire reflector in which additional reflecting segments are present to provide a greater degree of radiation control.
Figure 21:
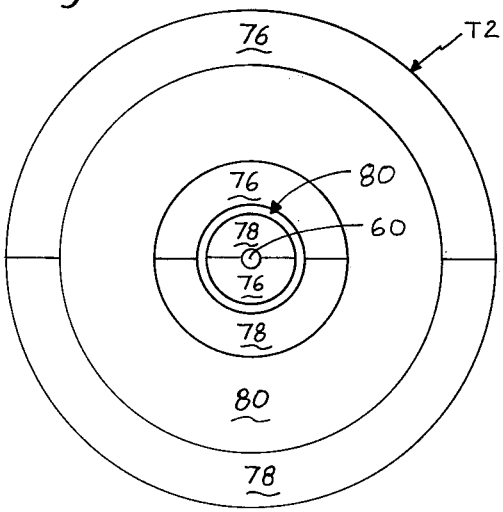
FIG. 21 is a diagrammatic view of a radiation transmitting member for use with the luminaire apparatus of FIG. 20.
Figure 22:
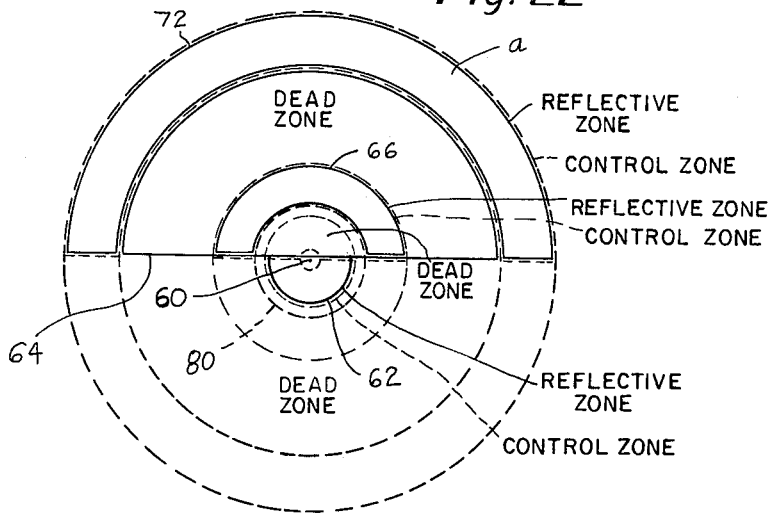
FIG. 22 illustrates the structure of FIG. 21 superimposed on that of FIG. 20.
Figure 23:
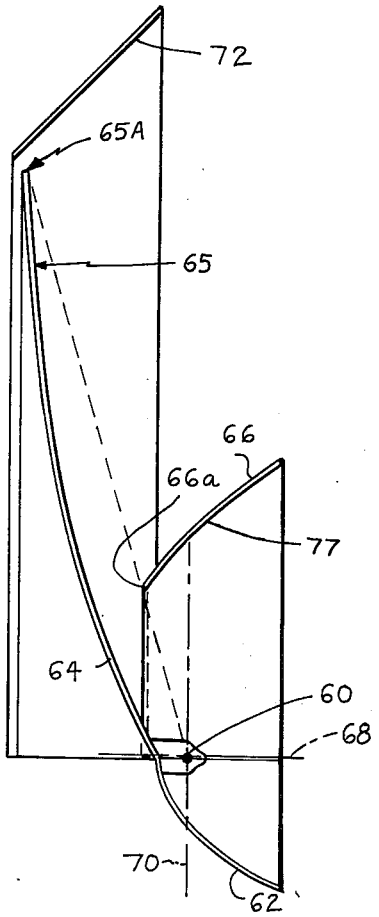
FIG. 23 is a cross section taken on the line 23—23 of FIG. 20.

The control zones of member T1 which may be comprised by convex lenses of short focal length as before are indicated at 54 and 56 in FIG. 17 and are shown in a position to produce a flood configuration in FIG. 18.

In this embodiment of FIGS. 16–19 as well as those of FIGS. 1–15 inclusive, there are included zones of uncontrolled radiation as indicated at the reflector zone 58. Radiation reflected can be regulated by choice of reflector body but cannot be made adjustable.

To increase the degree of light control it may be desirable to eliminate the uncontrolled zone denoted in the foregoing embodiments by numeral 58. This may be accomplished by modifying the reflector and radiation transmitting means as illustrated in FIGS. 44, 45, 46 and 47. This will have the effect of reducing the overall efficiency of the luminaire system but will eliminate the uncontrolled zone.

In another embodiment of the invention shown in FIGS. 20–23 inc. which includes a reflector system and a radiation transmitting means T2, there is illustrated apparatus for a method in which all reflected radiation may be adjusted without the loss of efficiency noted in the embodiment of FIGS. 44–47 inclusive. In this embodiment a source of radiant energy is located at the common focal point of parabolic segments 62, 64 and 66. Reflector segment 64 has its axis 70 perpendicular to axis 68. A fourth reflector element 72 is also provided being a simple surface characterized only by being at a 45 degree angle to axes 68 and 70. Paraboloidal surfaces are derived as before and dimensional characteristics determined as noted above.

Parameters of paraboloidal surface 64 such as location of its edges must be selected so that any radiation reflected from surface 65 will be perpendicular to axis 68 and parallel to axis 70 and will clear, i.e., not intersect surface 77. Edge **66*a* may not be located at any point further from axis 70 than the intersection of the base of light source 60 with reflective surface 64. The location of edge 65*a* is determined by the relationship between the focal point 60, edge 66*a* and reflector surface 65. In actual practice, surface 65 may extend beyond edge 65*a*. Surface 72 is at a 45 degree angle to both axes 68 and 70 and it must extend beyond edges 65*a* and 66*a* and must be positioned so that any rays reflected from surface 72, which rays will be parallel to axis 68, will clear or not intersect the rear of reflector segment 66. Dimension and locational adjustments may become necessary in the event that the optical systems must fit into a predefined space within a luminaire. Zones designated 76 would provide one setting when they are positioned in front of reflective segments 62, 66 and 72 while those of zones designated 78 would produce another setting when the radiation control member is rotated 180 degrees about its center to place these zones in front of reflective segments 62, 66 and 72**.

It should be noted that there are additional zones indicated at 80. These zones will never see reflected light because of the reflector configuration and therefore will not provide an adjustment of reflected radiation. The system described may become large enough to be quite cumbersome. Design may depend upon volume available degree of radiation control desired, or both.

It will also be noted that in the embodiments of FIGS. 16–19 inc. as well as FIGS. 20–23 inc. the radiation pattern will be symmetrical only about one axis perpendicular to the reflector axes which may be objectionable. Therefore, it may be desirable to utilize reflector and radiation transmitting means with a multiplicity of control zones. In such case and in order to preserve symmetry and provide maximum control, the number of control zones should be some even integer and the degree of rotation required to provide full adjustment from one setting to another will be equal to 360 degrees divided by the number of control zones.

Figure 24:
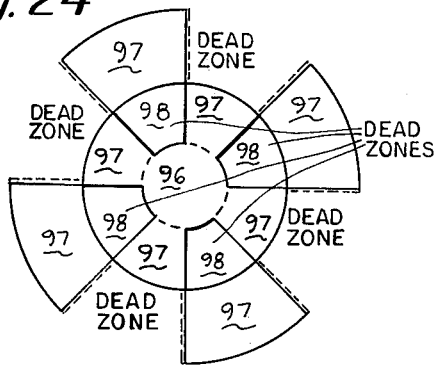
FIGS. 24–26 illustrate another modification in which eight zones of radiation control are present.

As an example of a multiplicity of zones, FIG. 24 illustrates diagrammatically a reflector assembly which includes eight zones of radiation control and one zone of uncontrolled radiation. Numeral 96 denotes the zone of uncontrolled radiation and is comparable to uncontrolled zone 58 of earlier described embodiments and is derived in the same manner. Numeral 97 refers to the eight reflector control zones and again these zones are comparable to the reflective zones in the embodiment of FIGS. 16–18 inc. as are dead zones 98. All surfaces denoted by numeral 97 are shown extending beyond their active zones to allow for manufacturing tolerances as illustrated by dashed lines in FIG. 24.

Figure 25:
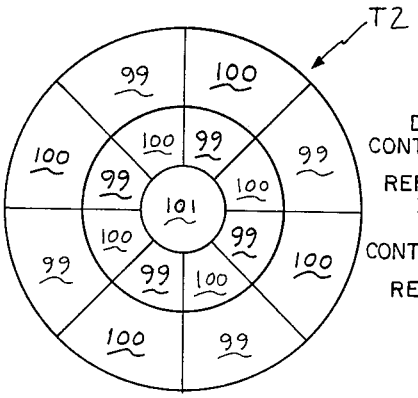
Figure 26:
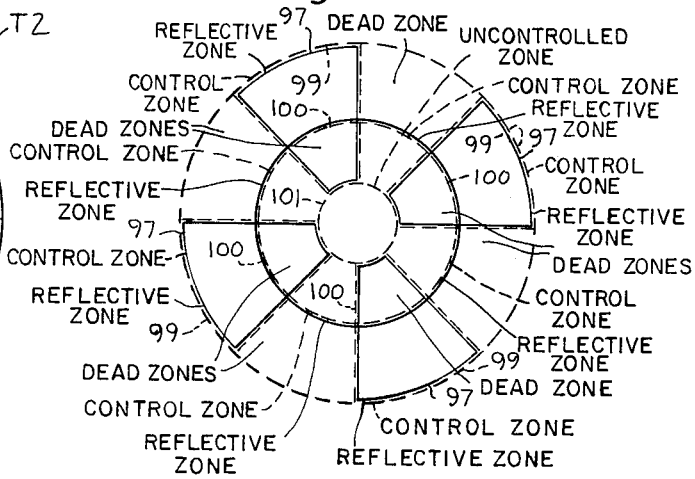

FIG. 25 illustrates control zones of a radiation transmitting means suitable for use with the reflector means of 24. Zones designated 99 provide one setting and zones 100 provide another setting. Zone 101 is not adjustable and was noted in earlier referred to embodiments. FIG. 26 illustrates the radiation transmitting means 25 superimposed on the reflector means of FIG. 24.

The technique of FIGS. 20–23 and FIGS. 44–47 inclusive may be employed to provide a greater degree of radiation control.

It may be desirable to use more than two settings and this becomes possible by expanding on the embodiments now described.

Figure 27:
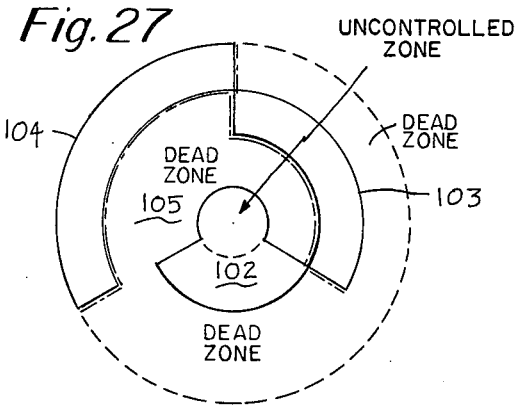
FIGS. 27–29 illustrate another modification of reflector system in which three separate and distinct settings are possible.

For example FIG. 27 is a front elevational view of a reflector system for use in an adjustable luminaire with three separate settings and with continuous adjustment between any two adjacent settings. This arrangement is an expansion of the embodiment of FIGS. 16–18 inc. Reflector surfaces are denoted at 102, 103 and 104 and numeral 105 denotes a dead zone. Paraboloidal surfaces for the various reflector segments are calculated as in the embodiment of FIGS. 16–18 inc. with provision made to insure that all radiation coming from a radiation source into the reflector system is in fact intercepted by a reflector surface, and the focal points of all reflector surfaces are coincident, and the reflected radiation does not strike the rear of any other reflector segment. As before some reflector surfaces may be slightly extended as shown by the dotted lines in FIG. 27.

Figure 28:
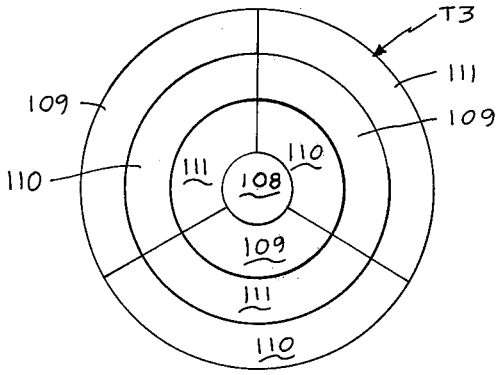
Figure 29:
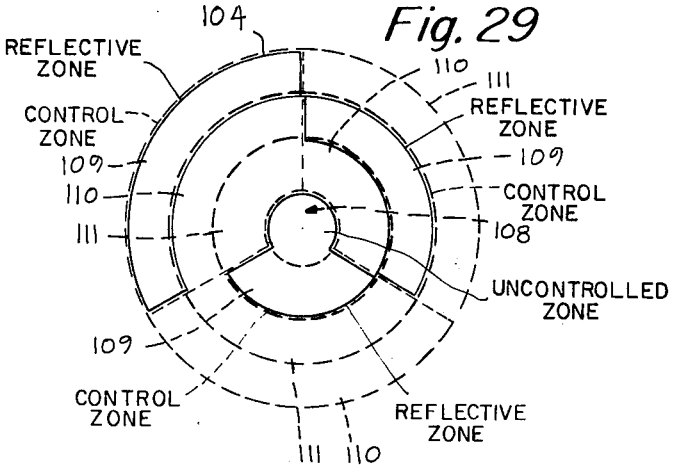

FIG. 28 illustrates transmitting means T3 having control zones suitable for use with the reflector system of FIG. 27. Zone 108 is an uncontrolled zone. Zone 109 will provide one setting when positioned in front of reflector surfaces 102, 103 and 104; zones 110 will produce another setting and zones 111 will produce yet another setting. Uncontrolled zone 108 can be minimized or eliminated by the techniques earlier disclosed in in the embodiments of FIGS. 20–23 and FIGS. 44–47 inclusive.

The reflector means illustrated and described in connection with FIGS. 1–29 inc. have in all cases been mounted directly on a luminaire body or designed to be supported on a luminaire body in some suitable manner. However, the invention is not limited to such an arrangement of reflector means and may for example be attached to or combined with a source of radiation such as a bulb member.

Figure 30:
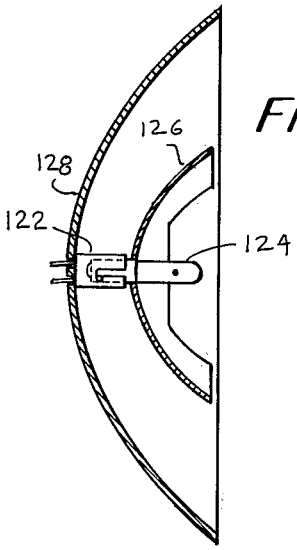
FIGS. 30 and 31 illustrate a reflector system in which an independently mounted reflector body having a bulb socket is combined with a second reflector member secured around a bulb member in the bulb socket.

FIG. 30 illustrates one such mounting of a reflector body wherein numeral 128 denotes a paraboloidal reflector of conventional nature which may be a component part of a standard luminaire body having a socket portion 122 in which is detachably received a bulb member 124. Secured around the base of the bulb 124 is a portable reflector body 126 having surfaces which are sections of paraboloids of revolution and as before having a common focal point with reflector 128 but of a differing focal length. By means of this arrangement, the bulb 124 and reflector 126 may be handled as a single unit and may be installed in any luminaire containing a paraboloidal reflector surface.

Figure 31:
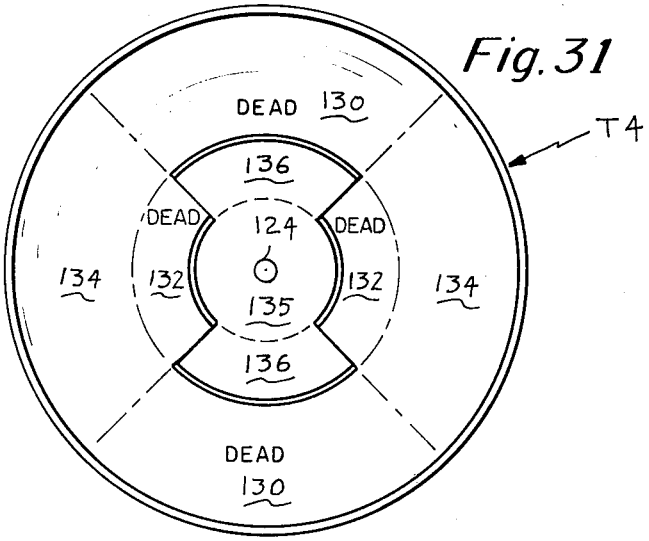

FIG. 31 illustrates one form of radiation transmitting means T4 suitable for use with the arrangement of FIG. 30 superimposed on the reflector arrangement of FIG. 30. Numerals 130 and 132 denote dead zones and numerals 134 and 136 denote radiation control zones. Numeral 135 denotes an uncontrolled zone.

Figure 32:
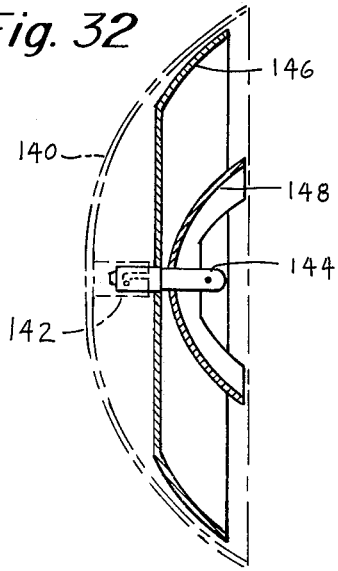
FIG. 32 illustrates a reflector system in which a luminaire body having a bulb socket is combined with two reflector bodies secured around a bulb in the bulb socket.

It may also be desired to utilize the invention in a luminaire body whose reflector surface may not be paraboloidal or which may contain no reflector surface. FIG. 32 illustrates a reflector system for use in such a luminaire body. Numeral 140 denotes generally a luminaire body having a socket 142 in which may be mounted a bulb 144.

Mounted around the base of the bulb 144 is a reflector body 146 of relatively long focal length and a second reflector body 148 of a relatively short focal length. As before, both reflectors are sections of paraboloids of revolution and have a common focal point and may be combined with a radiation transmitting means of the type earlier described.

Figure 33:
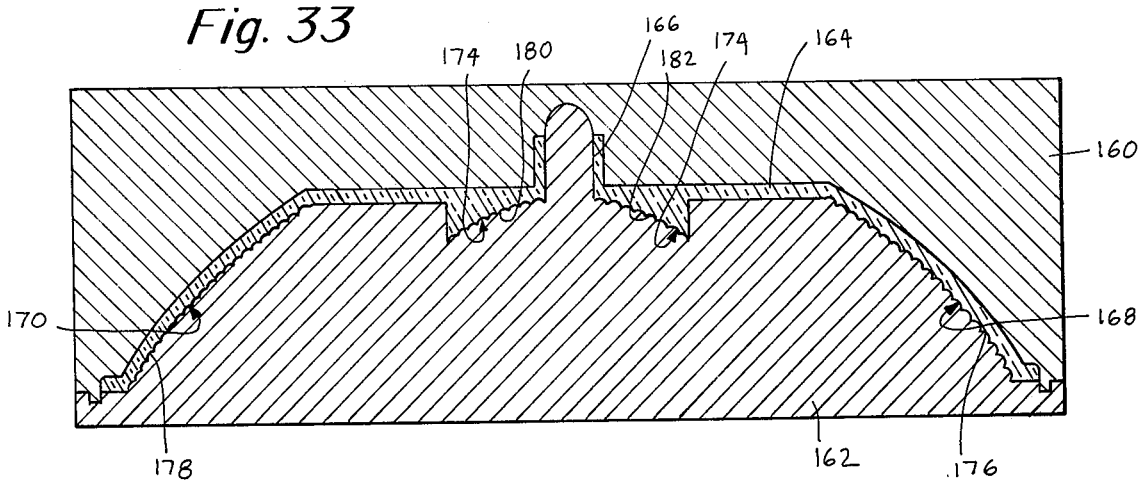
FIGS. 33–35 inc. illustrate a method of producing a bulb member having internal reflector surfaces of the desired configuration.

Provision of two or more reflector bodies mounted externally of a radiation source such as a bulb may be desirable for many purposes but may in other instances be less desirable than would be the case if the reflector surfaces were made as an integral part of the inner surface of a bulb enclosure. A method of forming a bulb with reflector surfaces at the inner surface therein as illustrated in FIGS. 33–36 inclusive. As shown in FIG. 33, a mold component 160 is formed with a mold cavity in which molten glass may be received and pressed into a desired shape by a mold core component 162 to form a bulb body 164. The bulb body is also formed with a centrally disposed tubular part 166.

The mold surfaces are chosen of a shape such that they form a pair of reflector portions 168 and 170 of relatively long focal length and another reflector portion 174 of relatively short focal length (FIG. 36). The forming surface of mold core 162 is further made of a shape to provide for the formation of a texture in the reflective surfaces as indicated at 176, 178, 180 and 182.

Figure 34:
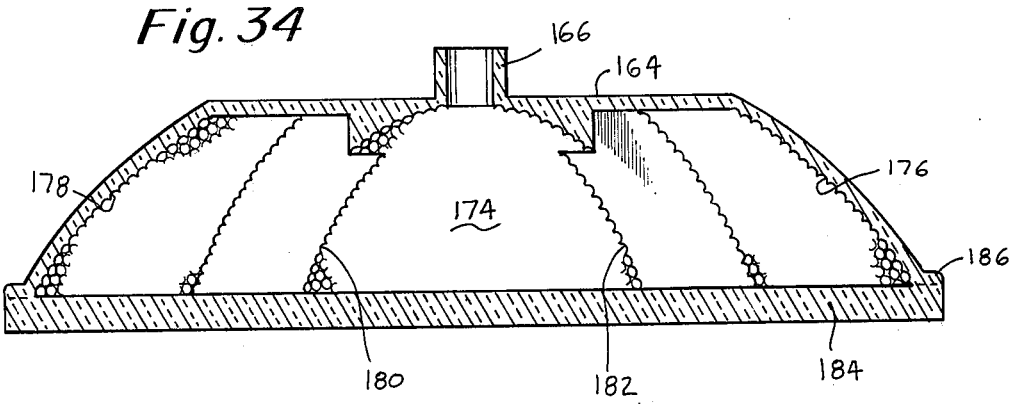
Figure 35:
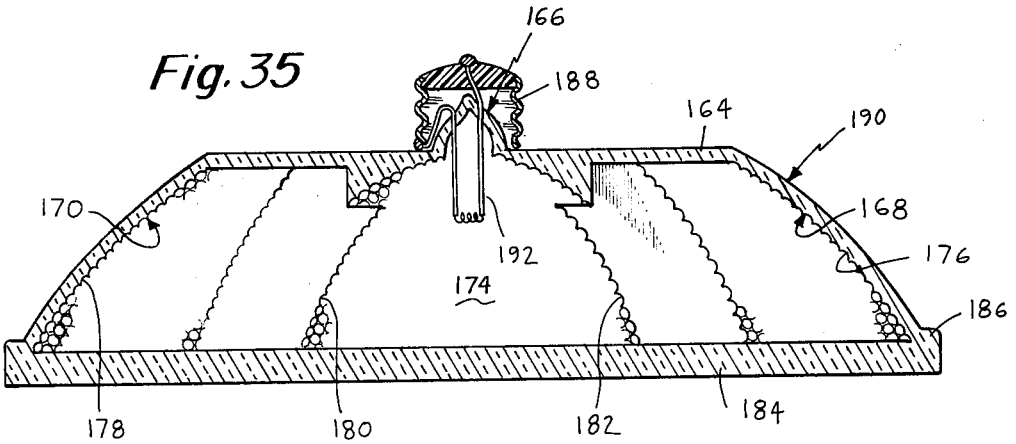
Figure 44:
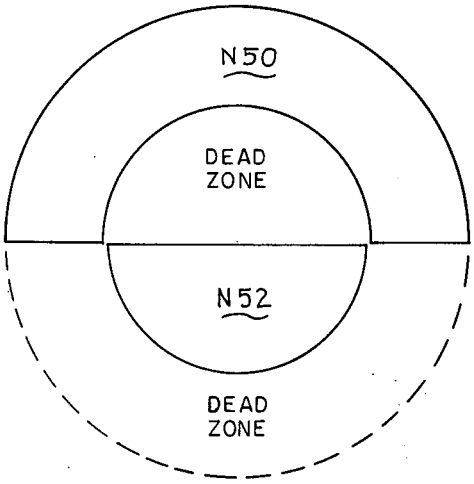
FIGS. 44, 45, 46 and 47 are views generally corresponding to FIGS. 16–19 inc. in which no zones of uncontrolled radiation are present.
Figure 45:
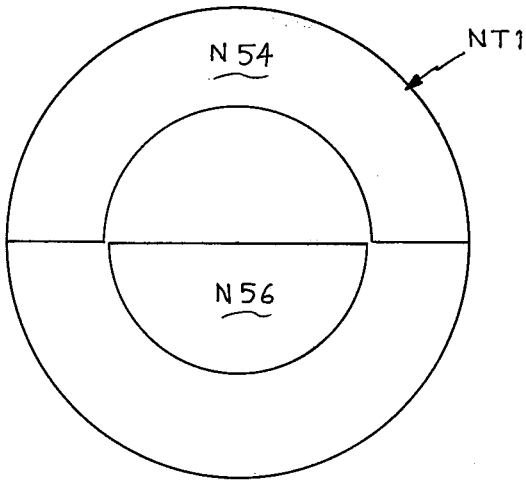
Figure 46:
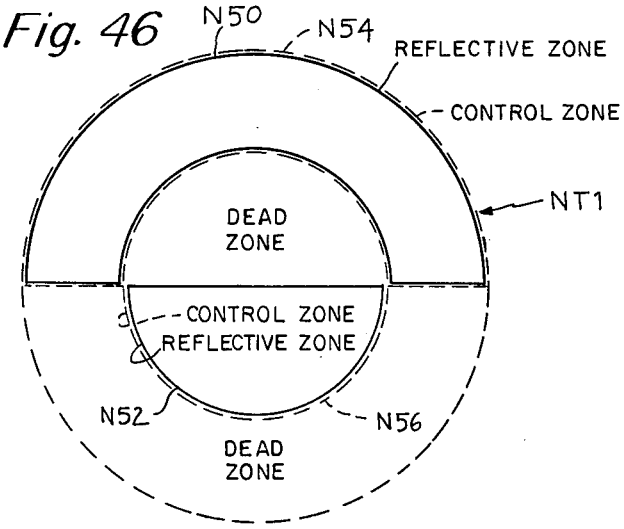
Figure 47:
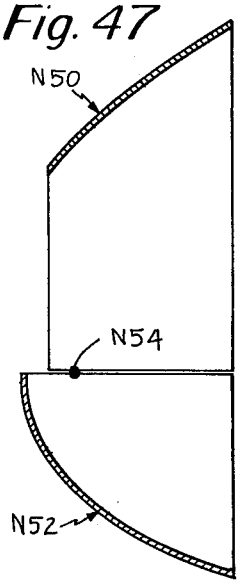

In FIG. 34, the molded body 164 is shown removed from the mold components and having its open side closed by means of a cover glass portion 184 which is fused to an annular flange 186 formed around the bulb body.

Surfaces denoted by 168, 170 and 174 are provided with a reflective coating by vacuum deposition of metal or some other method. A filament or other radiation producing element as 192 is inserted into the envelope through the centrally disposed tubular part 166 which is then fused to provide a hermetic seal, after evacuation of the bulb and introduction of any desired filler gas to the bulb. A standard screw or other type base 188 is then installed as in FIG. 35. FIG. 36 indicates a schematic view of the reflective surfaces formed by the foregoing techniques.

Radiation transmitting means suitable for use with the molded reflector surfaces of the bulb 164 is shown in FIGS. 37–39 inclusive and is generally indicated by T5. This member includes a circular body 196 having an inwardly projecting flange 199 (FIG. 39) which is rotatably supported around the bulb flange 186 by screw member 198 as shown in FIG. 39. At the inner side of the member T5 are two pairs of control zones 200, 202, and 204, 206 which are suitable for use with the reflector surfaces of the bulb in the manner earlier described and the inner sides of the control zones may be formed with convex lens elements of short focal length to provide a flood configuration in one position of adjustment and a spot configuration in another position of adjustment.

In some instances of use of the luminaire apparatus of the invention, it may be found desirable to employ a plurality of radiation transmitting means each of which may have varying zones of control. One example of such a modification is illustrated in FIG. 40.

As noted therein a luminaire housing 210 is provided of cylindrical form at one end of which may for instance be mounted a bulb 212 on which are supported reflector bodies corresponding to those earlier described and denoted by numeral 214.

Numeral 222 denotes one radiation control element and numeral 224 denotes a second radiation control element located in spaced relation to element 222. The control element 222 is formed with an annular flange 222' which as shown in FIG. 40 is constructed to fit snugly on over an end of member 210. At its opposite side control element 222 is formed with a similar flange 222'' into which is fitted a cylindrical housing section 227. These two cylindrical bodies 210 and 227 are detachably secured together by clips 216, 218 and 220 (not shown), which are engaged in clip recesses formed in outer side portions of the cylindrical bodies 210 and 227. These clips 216, 218 and 220 are arranged at 120 degree intervals around the cylindrical bodies and overlie and contain the radiation control element 222 as illustrated in FIG. 40. The arrangement of parts described provides for rotation of member 222 into any desired position of adjustment.

The radiation control element 224 above referred to is made similar in shape to element 222 and has one flange portion **224*a* fitted on over the cylindrical housing section 227 as illustrated in FIG. 40. At its opposite side radiation control element 224 is provided with a flange portion 224*b* into which is fitted another cylindrical section 226. Clips 216*a*, 218*a* and 220*a* engage in recesses in the cylindrical sections 227 and 226 to thereby secure these sections 227, 226 together and contain the radiation control element 224 so that it may be rotated into any desired position of adjustment independently of the element 222**.

It may be further desirable for certain uses of two or more radiation control elements to be able to locate the members together so that they rotate as one. FIGS. 42 and 43 illustrate one example of means for thus interlocking two control elements. As shown therein cylindrical sections 232, 235 and 237 are secured together by a plurality of clips 221 as indicated. Rotatably supported on these sections are radiation control elements 236 and 238 mounted with flange portions as noted above. It will be noted that the clips 221 are engaged in recesses in the cylindrical sections 232 and 237 and overlie both of the radiation control elements 236 and 238. In order to secure members 236 and 238 in interlocking relationship, there is further provided one or more key members **222*a* which are formed with dovetailed ends 223 arranged to fit into mating slots provided in the members 236 and 238**. The key means thus secures the two members together so that they may be rotated as a single unit and yet the keys may be removed at will to permit rotation of the control elements independently of one another if desired.

FIGS. 44, 45, 46 and 47 are views generally corresponding to FIGS. 16–19 inc. in which no zones of uncontrolled radiation are present.

In addition to the several modifications above disclosed it will also be understood that the radiation control zones of the various radiation transmitting means may in all embodiments consist of one or more of the following: (1) lens or prismatic surfaces for altering radiation distribution, (2) filtering means for altering color, (3) polarizing segments for altering polarization characteristics, (4) partially or wholly opaque surfaces for altering radiation intensity, (5) dichroic or other substances for altering relative intensity of specific wavelengths of transmitted radiation with respect to other wavelengths outside of the visible spectrum.

As earlier noted electrical power supplied through the screw type base of the luminaire housing 2 from an A.C. power source may also be furnished in other ways. FIGS. 48–59 inc. illustrate desirable forms of the invention in which electrical power is supplied from battery sources as well as from an A.C. power source through electrical conductor means.

Figure 48:
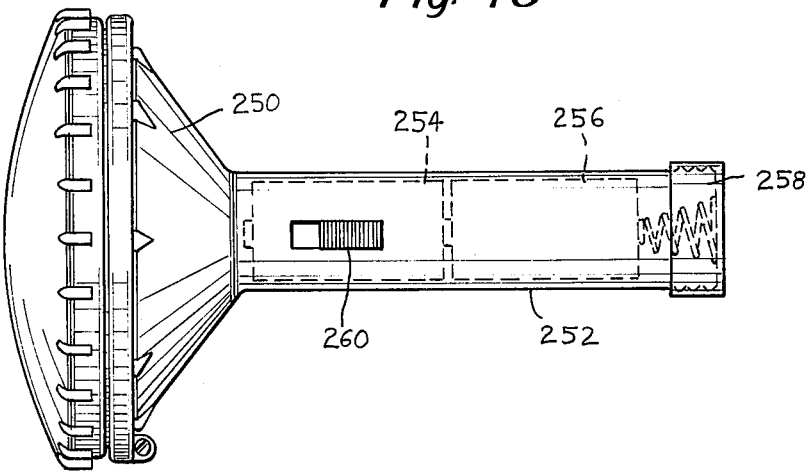
FIG. 48 illustrates the luminaire apparatus of the invention combined with a battery casing and battery power source of the class commonly used in flashlights.

In FIG. 48 numeral 250 denotes a luminaire housing body in which is contained reflector means, radiation control means and bulb means comparable to those in FIGS. 1–5 inclusive. The housing body is combined with a cylindrical extension 252 in which is received batteries 254 and 256 removable through the end of the cylinder when a screw cap 258 is detached. A switch 260 controls the flow of current from the battery to energize the luminaire bulb. The housing extension 252 not only functions as a battery casing but also serves as a handle for manually supporting the luminaire components.

Figure 49:
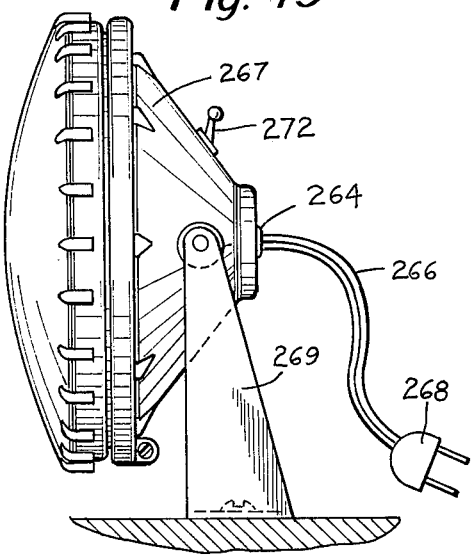
FIG. 49 illustrates the luminaire apparatus of the invention in combination with a detachable mounting bracket and conductor and plug means for direct engagement with a source of house current.

FIG. 49 illustrates a luminaire body 267 similar to that of FIGS. 1–5 inclusive but in place of a screw type base an electrical contact part 264 to which is connected an electrical line cord 266 and plug 268 for engagement in a wall outlet is provided. In this form the luminaire body 267 is portable and may be set up in any desired location on a detachable mounting bracket 269. A switch 272 controls operation.

Figure 50:
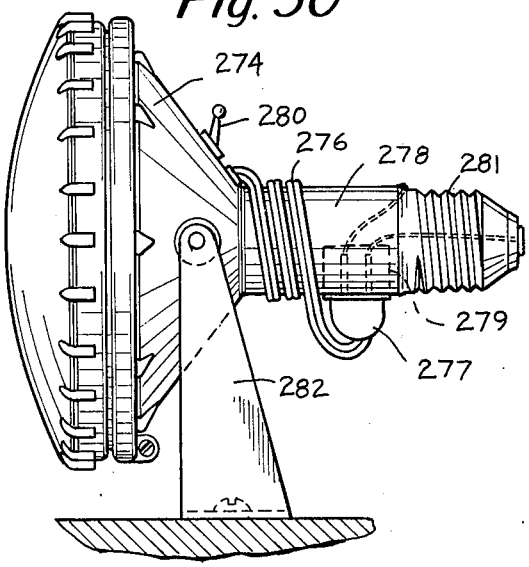
FIG. 50 illustrates the luminaire apparatus of the invention in combination with a detachable mounting bracket and means for connecting with house current either by an electrical plug or by engagement in a standard screw type socket.

In FIG. 50 a luminaire body 274 of the class described is designed to operate either with a line cord 276 with plug 277 which may be wound around an elongated base 278 which has a standard screw type extremity 281 for engagement in a standard screw-type socket. Base 277 is connected electrically only to receptacle 279 on elongated base 278. Plug 277 is inserted into receptacle 279 when operation from a screw-type socket is desired; for direct operation from a wall outlet plug 277 is engaged directly with the wall outlet. A switch 280 may control operation and a detachable bracket 282 may support the luminaire in a desired position.

Figure 51:
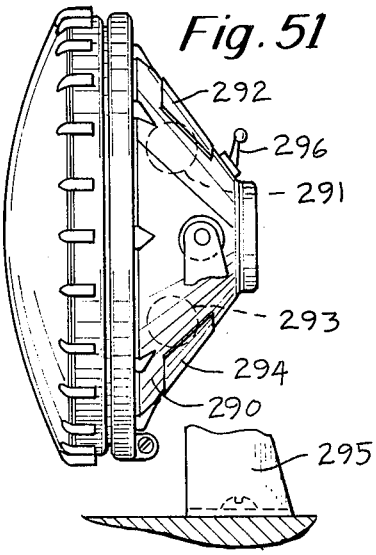
FIG. 51 illustrates another form of luminaire apparatus of the invention in which a source of radiant energy may be energized by battery means enclosed within the luminaire body itself.

In FIG. 51 a luminaire body 290 similar to that of FIGS. 1–5 inc. is constructed with battery compartments 291 and 293 and external access doors for replacing batteries at 292 and 294. The bulb in the housing is energized when the switch 296 is closed. Detachable bracket means 295 may be combined with this form of housing.

Figure 52:
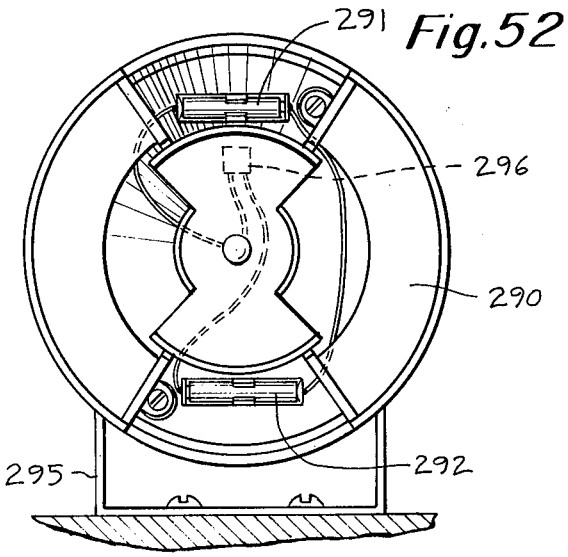
FIG. 52 is a front elevational view of the apparatus of FIG. 51 with a radiation transmitting member having been removed.

FIG. 52 illustrates the apparatus shown in FIG. 51 with a radiation transmitting member removed to more clearly show the batteries located in spaces made possible by the particular arrangement of reflector members of FIGS. 1–5 inclusive.

Figure 53:
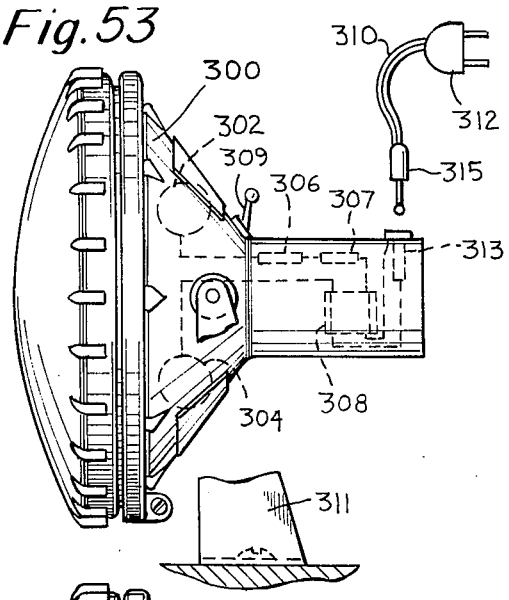
FIG. 53 is a side elevational view of apparatus similar to that shown in FIGS. 51 and 52 and further indicating a built-in charging mechanism together with line cord means for connecting with house current.
Figure 54:
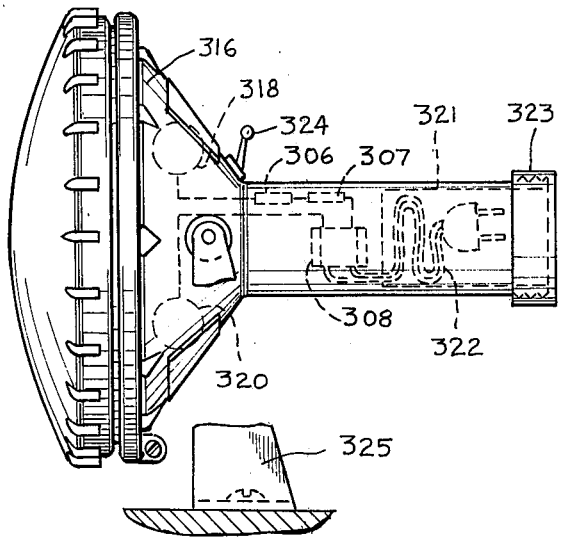
FIG. 54 is a view similar to FIG. 53 and further indicating compartment means in which the line cord of FIG. 53 may be stored within the luminaire body.

In FIG. 53 a luminaire body 300 similar to the luminaire body 290 is shown with battery means 302 and 304 contained therein and further illustrates the combination of a diode means 306, resistor means 307, and transformer means 308 connected to the battery in a manner such that a built-in charging system is present. Also included is a line cord 310 and plug 312 which can be engaged in wall outlet detachably connected to the luminaire body by insertion of plug 315 into receptacle 313. A detachable mounting bracket means 325 may be combined with this form of housing.

Figure 55:
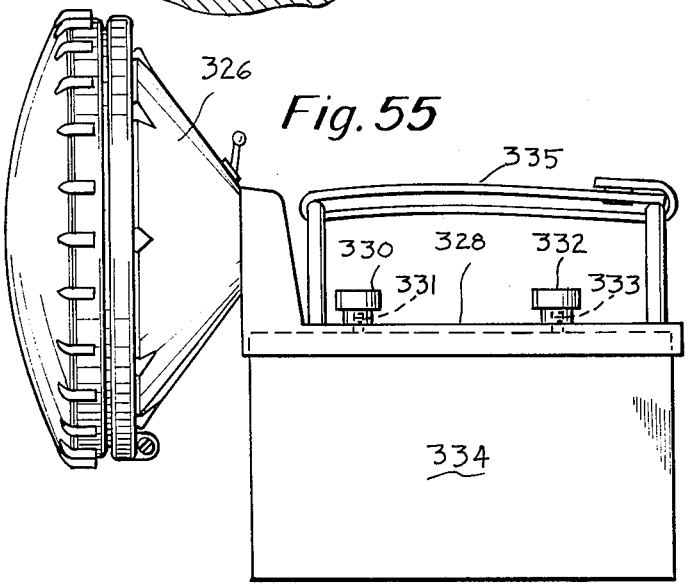
FIGS. 55 and 59 are side elevational views illustrating the luminaire apparatus of the invention combined with means for engagement with a standard lantern-type battery.

In FIG. 55 a luminaire body 326 similar to that of FIGS. 1–5 inclusive is combined with a battery cover 328 which may be attached by internally threaded contact caps 330 and 332 to threaded posts 331 and 333 of a standard lantern type battery 334. Handle means 335 may be detachably secured to battery cover 328.

Figure 56:
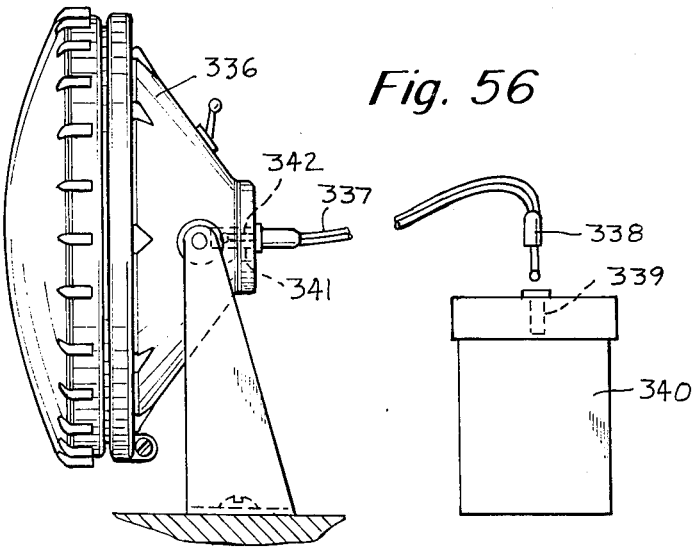
FIG. 56 is a view similar to FIG. 49 in which the power cord is designed for use with a remotely located battery.

FIG. 56 illustrates a luminaire body 336 similar to that of FIG. 49 is shown but including cord 337 and plug means 338 for connecting with a socket 339 on remotely located battery source 340. A socket 342 secured to the luminaire body 336 and engageable with plug means 341 for detachable connection at the luminaire may also be employed in lieu of direct connection of cord means 337 to the luminaire body 336.

Figure 57:
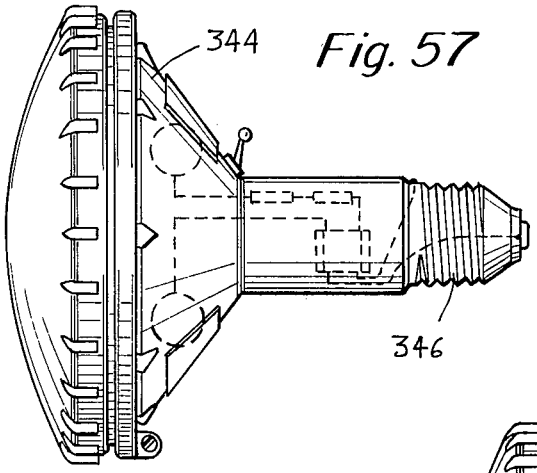
FIG. 57 is a view illustrating a luminaire apparatus which includes a charging mechanism similar to that of FIG. 53 but engageable in a standard screw type socket.

FIG. 57 illustrates a luminaire body 344 similar to that of FIG. 53 but including means for engagement with a standard screw socket by means of a standard screw-type base extremity 346.

Figure 58:
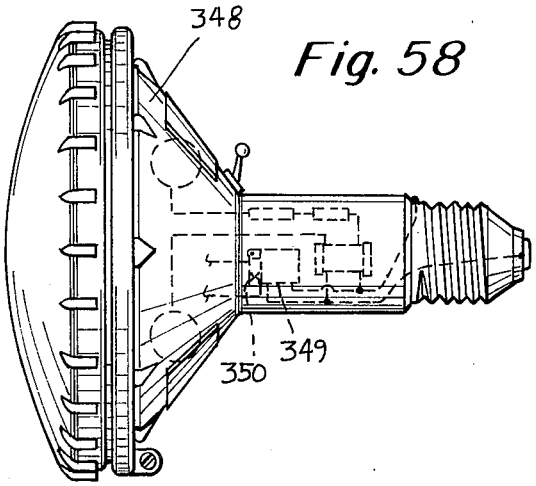
FIG. 58 is a view showing an apparatus similar to that of FIG. 57 but including an A.C. powered relay means for automatic activation of the apparatus with current from storage batteries in the event of A.C. power failure.

FIG. 58 illustrates a luminaire body 348 similar to that of FIG. 57 and further includes an A.C. operated relay means 349 with normally closed contact means 350 arranged in such a manner as to provide automatic energization of the light source from the batteries contained within the luminaire body 348 in the event of A.C. power failure.

Figure 59:
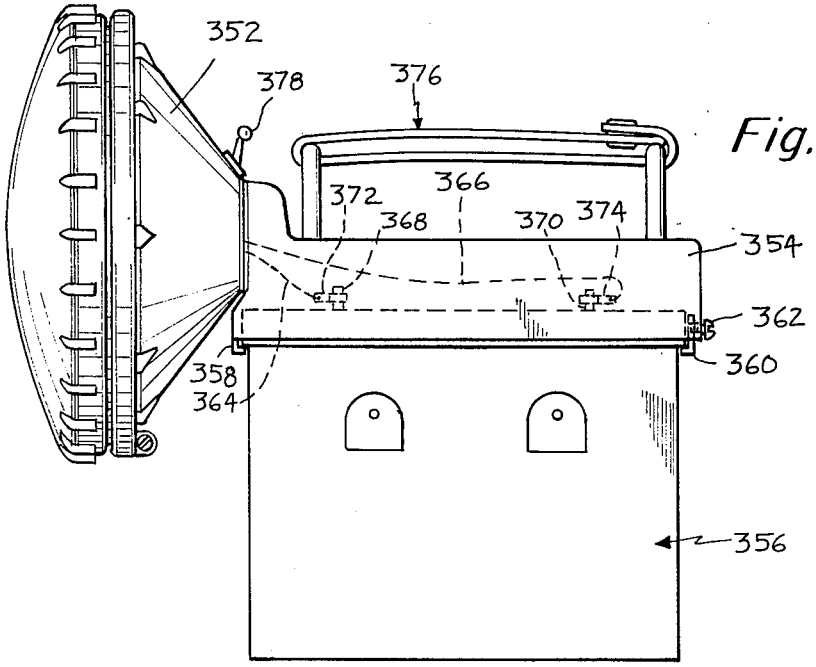

FIG. 59 illustrates a luminaire body 352 in combination with a battery cover 354 which may be detachably secured to a battery member 356 by means of projecting lip 358 and by clip 360 detachably secured to the battery cover 354 by screw means 362. Electrical conductor means 364 and 366 connected to the source of radiant energy within the luminaire body 352 may be detachably secured to battery posts 368 and 370 by means of clamps 372 and 374. The source of radiant energy may be energized from the battery member 356 by means of switch 378. Handle means 376 may be detachably secured to battery cover 354.

From the foregoing disclosure it will be evident that control of reflected radiation has been greatly extended and may be realized in a number of different classes of luminaire bodies utilizing a wide range of reflector and radiation transmitting means and activated by varying types of bulbs and other types of sources of radiant energy.

I claim:

1. Luminaire apparatus comprising a source of radiant energy, reflector means located in spaced relation to the source of radiant energy, said reflector means presenting a plurality of reflecting surfaces derived from the parabolic, said surfaces having a common focal point and differing focal lengths and being arranged to reflect radiant energy from the said source in substantially parallel rays, radiation transmitting means supported in the paths of travel of the substantially parallel rays and having a plurality of radiation control zones the planar projections of which are related in size and shape to the planar projections of paraboloidal reflecting surfaces for selectively controlling characteristics of the rays of radiant energy transmitted therethrough, and said reflector means and radiant energy transmitting means being mounted for rotary displacement of one relative to the other.

2. The invention of claim 1 in which the radiant energy transmitting means is rotatable and the reflector means is fixed.

3. The invention of claim 1 in which the radiant energy transmitting means is fixed and the reflector means is rotatable.

4. The invention of claim 1 in which the radiation transmitting means includes a plurality of transmitting elements mounted about common axes of rotation.

5. The invention of claim 1 in which the radiation transmitting means includes a plurality of transmitting elements mounted about common axes of rotation and being independently rotatable.

6. Luminaire apparatus comprising a housing body, a source of radiant energy received in the housing, a plurality of reflector members located in the housing body in spaced apart relation to the source of radiant energy, said reflector members presenting reflector surfaces derived from the parabolic and having a common focal point and differing focal lengths for reflecting radiant energy in substantially parallel rays, radiation transmitting means rotatably mounted on the housing in the path of travel of the substantially parallel rays, and said radiation transmitting means being formed with radiation control zones the planar projection of which correspond in size and shape to the planar projection of the said reflector surfaces for selectively controlling the characteristics of reflected radiant energy transmitted therethrough.

7. Luminaire apparatus comprising a source of radiant energy, a plurality of reflector members located in spaced apart relation to the source of radiant energy, said reflector members presenting reflector surfaces derived from the parabolic and having a common focal point and differing focal lengths, radiation transmitting means rotatably disposed in the path of travel of substantially parallel rays of radiant energy reflected from the said reflector surfaces, said radiation transmitting means being formed with radiation control zones the planar projections of which substantially correspond in size and shape to the planar projections of the said reflecting surfaces for modifying the characteristics of radiant energy transmitted therethrough, and other zones through which reflected radiant energy may pass without change in characteristics.

8. The invention of claim 7 in which said other zones may modify the characteristics of the radiant energy transmitted therethrough and in a way different from that accomplished by said first control zones.

9. Luminaire apparatus comprising a housing body, a source of radiant energy received in the housing body, a plurality of reflector members located in the housing body in spaced apart relation to the source of radiant energy, said reflector members presenting a plurality of reflector surfaces deriving from the parabolic, which surfaces have a common focal point and differing focal lengths and which define zones in which reflection occurs and other zones in which no reflection occurs, radiation transmitting means rotatably mounted on the housing body in the path of travel of rays of radiant energy reflected from the reflector surfaces, and said radiation transmitting means being formed with radiation energy control zones, the planar projections of which correspond in size and shape to the planar projections of some of the reflective zones of the reflector bodies and other zones through which radiant energy may be transmitted without change.

10. Luminaire apparatus comprising a casing member and a light source supported in the casing member, a plurality of reflector segments located in the casing in spaced apart relation to the said light source, said reflector segments presenting reflector surfaces derived from the parabolic and having a common focal point and differing focal lengths thereby to provide substantially parallel reflected rays of light, radiation transmitting means rotatable mounted on the casing in the path of travel of the reflected light rays, means in the radiation transmitting member for transmitting substantially parallel light rays to project a spot configuration and diffusing means in the radiation transmitting means movable into the path of travel of the substantially parallel light rays to provide a flood configuration.

11. The invention of claim 10 in which the means for providing a flood configuration consists of control zones having multiple convex lens elements of relatively short focal lengths formed in the radiation transmitting means.

12. The invention of claim 6 in which the degree of light control is maximized by having the focal lengths of some of the paraboloidal surfaces relatively short and the focal lengths of the remaining parabolic surfaces relatively long.

13. The invention of claim 6 in which the radiation control zones include means for producing change in color.

14. The invention of claim 6 in which the radiation control zones include diffusing means for producing a flood configuration.

15. The invention of claim 6 in which the radiation control zones include prismatic means for producing predetermined shaped configurations.

16. The invention of claim 6 in which the radiation control zones include a means for producing a change in intensity of the radiant energy.

17. The invention of claim 6 in which the radiation control zones include polarizing means for changing the polarization of the transmitted radiant energy.

18. The invention of claim 6 in which the radiation control means includes apparatus for changing the relative intensity of the transmission of various wave lengths of the radiant energy source.

19. The invention of claim 6 in which the radiation control means includes apparatus for changing multiple characteristics of the transmitted radiant energy.

20. The invention of claim 6 in which the degree of control of reflected radiant energy is maximized by the addition of a secondary reflecting surface derived from the parabolic and whose axis of rotation is positioned at an angle of 90 degrees from the axes of rotation of the said first reflector surfaces and having a common focal point with said first reflector surfaces, and the further addition of still another reflecting surface arranged in a position in the housing to enable it to receive radiant energy from the secondary reflector surface and redirect such energy at a common angle with that of reflected energy from the said first reflective surfaces.

21. The invention of claim 6 in which projection of the substantially parallel reflected rays is made to approach a generally circular configuration by increasing the number of said reflector surfaces.

22. The invention of claim 21 in which the number of reflector surfaces is chosen to provide a desired degree of circularity in the projected configuration of the radiant energy.

23. The invention of claim 6 in which the number of reflecting surfaces and radiation control zones are selected to provide a multiplicity of extremes of characteristic changes in the reflected radiant energy.

24. The invention of claim 1 in which the source of radiant energy is in an enclosure body having said reflecting surfaces formed as an integral part thereof.

25. The invention of claim 1 in which the source of radiant energy is a filament contained in an enclosure body and the enclosure body has paraboloidal reflecting surfaces formed internally thereof.

26. Luminaire apparatus comprising a housing body having a paraboloidal reflecting surface formed therein, a source of radiant energy, support means for detachably securing the source of radiant energy in the housing body, paraboloidal reflector members attached to the support means in spaced apart relation, said first paraboloidal reflecting surface and said attached reflector members having a common focal point and differing focal lengths to provide reflecting and non-reflecting zones, and radiation transmitting means mounted in spaced relation to the said reflecting surface and attached reflecting members for controlling the characteristics of reflected radiant energy transmitted therethrough.

27. Luminaire apparatus comprising a housing having receptacle means for receiving a source of radiant energy therein, a source of radiant energy in the form of a bulb member removably engaged in the housing receptacle, said housing presenting an inner reflecting surface and said bulb having paraboloidal reflector members of relatively long focal length attached thereto in spaced apart relation and paraboloidal members of relatively short focal length also attached thereto, all of said paraboloidal reflector members having a common focal point, and radiation transmitting means rotatably supported in the path of radiant energy reflected by the said reflector members for modifying characteristics of the transmitted rays.

28. The invention of claim 6 in which the said radiation transmitting means includes a plurality of cylindrical mounting bodies detachably fastened to one another and a plurality of radiation transmitting members received in respective cylindrical mounting bodies and being rotatable independently of one another.

29. The invention of claim 6 in which the said radiation transmitting means includes a plurality of cylindrical mounting bodies detachably fastened to one another and a plurality of radiation transmitting members received in respective cylindrical mounting bodies and being rotatable independently of one another, and means for securing the radiation transmitting members in interlocking relationship.

30. The invention of claim 27 in which the housing receptacle means consists of a screw type socket and the said bulb is formed with a threaded extremity for engaging in the screw type socket and the said reflector members being attached to the bulb adjacent to the threaded extremity.

31. The invention of claim 27 in which the reflector members are detachably secured to the bulb.

32. The invention of claim 1 in which the source of radiant energy is comprised of electrodes in an ionizing gas atmosphere capable of supporting an electrical arc contained within the enclosure body and the enclosure body has essentially paraboloidal reflecting surfaces formed internally therein.

33. The apparatus of claim 6 in which the source of radiant energy is a bulb and the luminaire housing body includes battery compartments and battery means therein electrically connected to said bulb, and switch for controlling operation of the battery means.

34. The invention of claim 6 in which the housing body includes detachable bracket means for supporting the housing in an adjustable position and line cord means for connecting the source of radiant energy with a wall outlet, and switch means for controlling the line cord means.

35. The invention of claim 6 in which the housing body includes a detachable bracket and screw base for engaging with a housing current socket and a line cord plug and receptacle means for selectively connecting the source of radiant energy to an electrical wall outlet or standard screw type socket, and with means for energizing the source of radiant energy.

36. The invention of claim 6 in which the plurality of reflecting surfaces are arranged in spaced apart relation to provide storage spaces, battery means contained in the storage spaces and electrically connected to the source of radiant energy, and switch means for controlling operation of said battery means.

37. The invention of claim 6 in which the reflector members are arranged in spaced apart relation to define storage spaces, battery means contained within the storage spaces and electrically connected to the source of radiant energy, switch means for controlling said battery means, and means for recharging the said battery means.

38. The invention of claim 6 in which the reflector members are arranged in spaced apart relation to define storage spaces, battery means contained within the storage spaces and electrically connected to the source of radiant energy, switch means for controlling said battery means, means for recharging the said battery means, said recharging means including a line cord having a plug member for connecting with a wall outlet.

39. The invention of claim 6 in which the reflector members are arranged in spaced apart relation to define storage spaces in which are contained battery means electrically connected to the source of radiant energy, switch means for controlling said battery means, means for recharging the said battery means and said recharging means including electrical cord and plug stored in the housing body.

40. The invention of claim 6 in which the housing body includes a connector top and threaded connection cap means for fastening the top to a standard lantern type battery.

41. The invention of claim 6 in which the reflector means are arranged in spaced apart relation to define storage spaces in which battery means are contained, switch means for controlling operation of the battery means, means for recharging the said battery means and said housing further presenting a screw type for engagement with a standard screw-type socket to energize the recharging means and to energize the source of radiant energy independently of the battery means.

42. The invention of claim 6 in which the reflector members are arranged in spaced apart relation to define storage spaces in which battery means are contained and electrically connected to the source of radiant energy switch means, means for recharging the said battery means and said housing further constructed with a screw type base for engagement in a standard screw type socket for energizing the source of radiant energy, and the said recharging means, and relay means for activating the battery means when flow of current through the screw type base to the source of radiant energy is interrupted.

43. The invention of claim 6 in which the housing body includes a cover detachably secured to a battery, clamp means for detachably connecting electrical conductors to the terminal post of the battery, and having switch means for energizing the source of radiant energy.

44. The invention of claim 1 in which the reflector surfaces are textured to preclude the projection of radiation from appearing as an image of the planar projection of the reflector surfaces.

* * * * *